US005314859A

United States Patent [19]

Takahashi et al.

[11] Patent Number: 5,314,859

[45] Date of Patent: * May 24, 1994

[54] THERMOSENSITIVE RECORDING MATERIAL

[75] Inventors: Yoshiyuki Takahashi, Kawasaki; Makoto Nishioka, Tokyo; Kunitaka Toyofuku, Chiba; Kyoko Uchida, Machida, all of Japan

[73] Assignee: Oji Paper Co., Ltd., Tokyo, Japan

[ * ] Notice: The portion of the term of this patent subsequent to Oct. 26, 2010 has been disclaimed.

[21] Appl. No.: 976,515

[22] Filed: Nov. 13, 1992

[30] Foreign Application Priority Data

| | | | |
|---|---|---|---|
| Nov. 15, 1991 | [JP] | Japan | 3-300491 |
| Dec. 25, 1991 | [JP] | Japan | 3-342814 |
| Dec. 25, 1991 | [JP] | Japan | 3-342837 |
| May 27, 1992 | [JP] | Japan | 4-135117 |

[51] Int. Cl.[5] ..... B41M 5/30

[52] U.S. Cl. ..... 503/207; 503/209; 503/216; 503/225

[58] Field of Search ..... 503/209, 214, 216, 225, 503/207

[56] References Cited

U.S. PATENT DOCUMENTS

| | | | |
|---|---|---|---|
| 3,539,375 | 11/1970 | Baum | 117/36.2 |
| 4,531,139 | 7/1985 | Seitz | 346/210 |

FOREIGN PATENT DOCUMENTS

| | | |
|---|---|---|
| 2327135 | 12/1973 | Fed. Rep. of Germany . |
| 43-4160 | 12/1968 | Japan . |
| 45-14039 | 5/1970 | Japan . |
| 48-27736 | 4/1973 | Japan . |
| 56-146794 | 11/1981 | Japan . |
| 58-199189 | 11/1983 | Japan . |
| 59-93387 | 5/1984 | Japan . |
| 59-114096 | 6/1984 | Japan . |
| 59-167292 | 9/1984 | Japan . |
| 60-78782 | 5/1985 | Japan . |
| 62-164579 | 7/1987 | Japan . |
| 62-169681 | 7/1987 | Japan . |

OTHER PUBLICATIONS

Patent Abstracts of Japan, vol. 9, No. 46 (M-360)(1769) Feb. 27, 1985.

Patent Abstracts of Japan, vol. 6, No. 105 (M-136)(983) Jun. 15, 1982.

*Primary Examiner*—Pamela R. Schwartz

*Attorney, Agent, or Firm*—Armstrong, Westerman, Hattori, McLeland & Naughton

[57] ABSTRACT

A thermosensitive recording material capable of recording thereon clear colored images having high resistances to oily substances, plasticizers, moisture, and heat and an excellent storage persistency over a long time, comprises a thermosensitive colored image-forming layer formed on a sheet substrate and comprising a colorless dye precursor, a color developing agent, and a binder, the color developing agent comprising at least one compound of the formula (I):

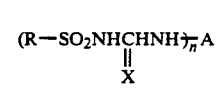

(I)

and the colored image-forming layer further comprising an additive comprising at least one selected from: (1) aromatic epoxy compounds, (2) aromatic aziridine compounds, (3) aromatic compounds of the formulae (II), (III) and (IV):

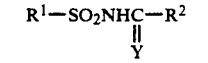

(I)

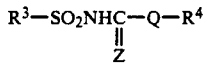

(III)

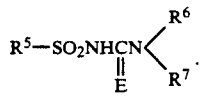

(IV)

19 Claims, No Drawings

THERMOSENSITIVE RECORDING MATERIAL

BACKGROUND OF THE INVENTION

1. Field of the Invention

The present invention relates to a thermosensitive recording material on which colored images are formed by heating. More particularly, the present invention relates to a thermosensitive recording material capable of forming thereon colored images reluctant to fade and thus exhibiting a high degree of persistency during extended storage thereof.

The thermosensitive recording material of the present invention is capable of recording thereon colored images exhibiting an excellent resistance to moisture, heat, oily and fatty substances, and plasticizers, and thus has superior persistency when stored over a long period of time and therefore is useful as colored image-recording sheets, sheets for use in facsimiles, word processors, CRT image printers and cash dispensers, as passenger tickets, commuter passes, labels such as POS labels, cards such as prepaid cards, and as transit passes.

2. Description of the Related Arts

It is known that a conventional thermosensitive recording material comprises a supporting substrate, for example, a paper sheet, synthetic paper sheet, or plastic resin film and a thermosensitive colored image-forming layer formed on a surface of the supporting substrate and comprising an electron-donative dye precursor, for example, a leuco basic dye, an electron-acceptive color-developing agent consisting of an organic acid substance, for example, a phenolic compound, and a binder. When the thermosensitive colored image-forming layer is heated imagewise, colored images are recorded thereon by a reaction of the dye precursor with the color-developing agent.

This type of thermosensitive recording material is disclosed in Japanese Examined Patent Publication Nos. 43-4,160 and 45-14,039 and Japanese Unexamined Patent Publication No. 48-27,736, and is widely employed in practice.

Namely, the thermosensitive recording material is advantageous in that colored images can be easily formed by heating alone, and the recording apparatus can be made compact and small in size, has a relatively low price, and can be easily maintained. Therefore, the thermosensitive recording material is appreciated as a useful information-recording material for recording outputs of printers used with, for example, computers, facsimile machines, automatic ticket-vending machines, scientific measurement recorders, and CRT medical measurement recorders.

Nevertheless, the conventional dye-forming type thermosensitive recording materials in which the thermosensitive colored image-forming layer comprises a conventional color-developing agent together with the dye precursor and the binder is disadvantageous in that the resultant colored images fade with the lapse of time, presumably because of a reversible reaction of the dye precursor with the color-developing agent. This fading of the colored images is accelerated by exposure to light, high temperatures, and high humidity and is specifically promoted by contact with an oily or fatty substance or a plasticizer, to such an extent that the faded images cannot be recognized.

Many attempts have been made to retard or inhibit the fading of the colored images formed on a conventional thermosensitive colored image-forming layer containing a substantially colorless dye precursor comprising a lactone ring compound.

For example, Japanese Unexamined Patent Publication Nos. 60-78,782, 59-167,292, 59-114,096 and 59-93,387 disclose a thermosensitive colored image-forming layer containing a phenolic antioxidant.

Japanese Unexamined Patent Publication No. 56-146,794 discloses a protective layer formed from a hydrophobic polymeric compound emulsion on a thermosensitive colored image-forming layer.

Japanese Unexamined Patent Publication No. 58-199,189 discloses formation of both an intermediate layer and a top layer on a thermosensitive colored image-forming layer; the former being formed from a water-soluble polymeric compound solution or a hydrophobic polymeric compound emulsion and the latter being formed from a solvent-soluble hydrophobic polymer on the intermediate layer.

Japanese Unexamined Patent Publication No. 62-164,579 discloses a thermosensitive colored image-forming layer containing an epoxy compound in addition to a phenolic color-developing agent.

Japanese Unexamined Patent Publication No. 62-169,681 discloses metal salts of specific salicylic acid derivatives usable as a color-developing agent.

In the thermosensitive colored image-forming layer containing the phenolic antioxidant, the resultant colored images exhibit a higher resistance to heat and moisture to a certain extent compared to the colored images formed on a conventional colored image-forming layer free from the phenolic antioxidant, but the improvement effect of the phenolic antioxidant is not satisfactorily high. Also, the phenolic antioxidant does not have the capability to enhance the resistance of the colored images to the oily or fatty substances, for example, salad oil, and plasticizers, for example, dioctyl phthalate. The resistance of the colored images to oily or fatty substance or a plasticizer is determined in such a manner that the colored images are brought into contact with an oily or fatty substance, for example, a salad oil or a plasticizer, and left in contact therewith for a predetermined time, and then a retention of the color density of the tested colored images is measured in comparison with an initial color density thereof.

When the protective layer or the intermediate and top layers are formed on the thermosensitive colored image-forming layer, the resultant colored images exhibit a significantly enhanced persistency when the salad oil or the dioctyl phthalate is brought into contact with the colored image-forming surface of the recording material. Nevertheless, when the salad oil or the dioctyl phthalate is brought into contact with an edge face of the recording material, it penetrates the inside of the recording material and causes a complete fading of the colored images. Therefore, the provision of the protecting layer or the intermediate and top layer cannot completely eliminate the undesirable color-fading of the images.

The addition of the epoxy compound to the phenolic color developing agent, is not totally appreciated, because it takes a long time to stabilize the colored images formed on the colored image-forming layer after a heat-recording operation, and therefore, if salad oil, or a plasticizer is brought into contact with the colored image-forming layer immediately after the heat-recording operation, the resultant colored images fade to a great extent.

The addition of the metal salts of the specific salicylic acid derivative to the colored image-forming layer effectively enhances the resistances of the colored image-forming layer to the oily or fatty substances and to the plasticizers. When the resultant thermosensitive recording sheet is subjected to a colored image-recording procedure and then to a heat resistance test, however, an undesirable color-development occurs on non-image-formed white portions of the recorded sheet. Also, the utilization of the specific salicylic acid derivative metal salts is disadvantageous in that this chemical has a complicated chemical structure and thus is expensive.

Generally, a thermosensitive recording material having a high persistency of colored images, which must have a surface layer, contain a special additive or use a special color-forming material, is disadvantageous in that the thermosensitivity is relatively low.

SUMMARY OF THE INVENTION

An object of the present invention is to provide a thermosensitive recording material capable of forming colored images thereon having excellent resistance to oily and fatty substances, plasticizers, moisture, and heat, and thus exhibiting superior persistency over a long time.

Another object of the present invention is to provide a thermosensitive recording material useful for thermorecording type tickets of automatic ticket-vending machines, commuter passes, and coupon tickets, which must have high persistency of the colored images recorded thereon, and for label sheets to be used in a POS bar code price-indicating system in which the label sheets are frequently attached to a surface of a polyvinyl chloride film containing a plasticizer and for wrapping fresh food or meat containing an oily or fatty substance; the label sheets of which are unavoidably brought into contact with the plasticizer and/or oily or fatty substance.

A further object of the present invention is to provide a thermosensitive recording material useful as facsimile recording sheets, word processor recording sheets, and CRT image printing sheets, which all must have high persistency of colored images recorded thereon.

The above-mentioned objects can be attained by the thermosensitive recording material of the present invention, which comprises a sheet substrate and a thermosensitive colored image-forming layer formed on a surface of the sheet substrate and comprising a substantially colorless dye precursor, a color developing agent reactive with the dye precursor upon heating to thereby develop a color, and a binder, the color developing agent comprising at least one compound of the formula (I):

$$(R-SO_2NH\underset{\underset{X}{\|}}{C}HNH)_n A \qquad (I)$$

wherein X represents a member selected from the group consisting of oxygen and sulfur atoms; R represents a member selected from the group consisting of unsubstituted aromatic hydrocarbon groups and substituted aromatic hydrocarbon groups having at least one substituent selected from the group consisting of lower alkyl groups and halogen atoms; A represents a multivalent group and n represents an integer of 2 or more, and the thermosensitive colored image-forming layer further comprising an additive comprising at least one member selected from the group consisting of:

(1) aromatic epoxy compounds having at least one epoxy group per molecule thereof;

(2) aromatic aziridine compounds having at least one aziridinyl group per molecule thereof;

(3) aromatic compounds of the formulae (II), (III) and (IV):

$$R^1-SO_2NH\underset{\underset{Y}{\|}}{C}-R^2 \qquad (II)$$

wherein Y represents a member selected from the group consisting of oxygen and sulfur atoms, $R^1$ represents a member selected from the group consisting of unsubstituted aromatic ring groups, and substituted benzene ring groups having at least one substituent selected from the group consisting of lower alkyl groups and halogen atoms, and $R^2$ represents a member selected from the group consisting of alkyl groups, aralkyl groups, unsubstituted aromatic ring groups, and substituted aromatic ring groups having at least one substituent selected from the group consisting of alkyl groups, aryl groups, aralkyl groups and halogen atoms, $$R^3-SO_2NH\underset{\underset{Z}{\|}}{C}-Q-R^4 \qquad (III)$$

wherein Z and Q respectively and independently from each other represent a member selected from the group consisting of oxygen and sulfur atoms, $R^3$ represents a member selected from the group consisting of unsubstituted benzene ring groups and polynuclear aromatic groups and substituted benzene ring groups having at least one substituent selected from the group consisting of lower alkyl groups, aryl groups and halogen atoms, and $R^4$ represents a member selected from aralkyl groups, alkyl groups substituted with an aryloxy group, substituted benzene and polynuclear aromatic ring groups each having at least one substituent selected from the group consisting of alkyl, alkenyl, aryl, aralkyl, alkyloxy, aryloxy, aralkyloxy, alkylmercapto, arylmercapto, aralkylmercapto, alkyloxycarbonyl, aryloxycarbonyl, and aralkyloxycarbonyl groups and halogen atoms, and unsubstituted benzene ring and polynuclear aromatic ring groups, and $$R^5-SO_2NH\underset{\underset{E}{\|}}{C}N\begin{matrix}R^6\\R^7\end{matrix} \qquad (IV)$$

wherein E represents a member selected from the group consisting of oxygen and sulfur atoms; $R^5$ represents a member selected from the group consisting of unsubstituted aromatic ring groups, and substituted benzene ring groups having at least one substituent selected from the group consisting of lower alkyl groups and halogen atoms, and $R^6$ and $R^7$ respectively and independently from each other represent a member selected from the group consisting of a hydrogen atom, unsubstituted alkyl groups, aralkyl groups, alkyl groups substituted with an aryloxy group, unsubstituted aromatic ring groups, and substituted aromatic ring groups having at least one substituent selected from the group consisting of alkyl, aryl, aralkyl, alkyloxy, alkyloxycarbonyl, aryloxycarbonyl, aralkyloxycarbonyl and arylsulfonyl groups and halogen atoms;

(4) aromatic sulfonyl compounds different from the compounds of the formulae (I), (II), (III) and (IV), provided with at least one sulfonyl group per molecule thereof and having a melting point of from 60° C. to 160° C.; and (5) basic white pigments.

DESCRIPTION OF THE PREFERRED EMBODIMENTS

In the thermosensitive recording material of the present invention, a thermosensitive colored image-forming layer is formed on a surface of a sheet substrate and comprises a substantially colorless dye precursor, a specific color developing agent reactive with the dye precursor upon heating to thereby develop a color, a specific additive and a binder.

The color developing agent comprises at least one compound of the formula (I) having at least two N-arylsulfonyl(thio) urea groups of the formula (V);

$$R-SO_2NH\underset{\underset{X}{\|}}{C}NH- \qquad (V)$$

wherein X and R are as defined above.

When heated together with leuco dyes, the compound of the formula (I) effectively causes the resultant colored images, even immediately after the formation thereof, to exhibit an excellent resistance to oily and fatty substances and plasticizers, moisture and heat and thus a superior persistency over a long period of time.

The compounds of the formula (I) do not have acidic functional groups, for example, a phenolic hydroxyl group or carboxyl group. Nevertheless, the compounds of the formula (I) exhibit a strong color developing ability for the dye precursor consisting of a basic leuco dye. The reasons for the strong color developing ability have not yet been completely made clear, but it is assumed that the (thio) urea groups in the compounds of the formula (I) are activated by the sulfonyl group located adjacent to the (thio) urea group and exhibit color developing activity.

Also, the reasons for the superior persistency of the colored images developed by the compound of the formula (I) even in various severe circumstances have not yet been completely made clear, but it is presumed that a synergistic effect of the two or more N-arylsulfonyl(thio) urea groups of the formula (V) are highly contributory to stabilizing the resultant colored images.

In the formula (I), the multivalent group represented by A is not limited to specific groups as long as the group has a valency of two or more and is capable of connecting the two or more N-arylsufonyl(thio) urea groups of the formula (V) to each other therethrough. Nevertheless, the multivalent group A is preferably selected from the group consisting of:

(a) divalent carbonyl, thiocarbonyl and sulfonyl groups;

(b) multivalent aliphatic hydrocarbon groups;

(c) multivalent, hetero-atom-containing aliphatic groups derived from aliphatic hydrocarbon compounds having at least one hetero-atom located in a backbone chain per molecule thereof;

(d) multivalent aliphatic groups derived from aliphatic hydrocarbon compounds having at least one member selected from the group consisting of carbonyl, thiocarbonyl, imide, imino, and sulfonyl groups and ester structures, located in a backbone chain per molecule thereof;

(e) multivalent aliphatic aromatic (aroaliphatic) groups derived from aliphatic hydrocarbon compounds having at least one member selected from the group consisting of unsubstituted and substituted aromatic hydrocarbon groups, located in a backbone chain per molecule thereof;

(f) multivalent organic groups derived from aliphatic hydrocarbon compounds having at least one member selected from the group consisting of unsubstituted and substituted hetero-cyclic groups, located in a backbone chain per molecule thereof;

(g) multivalent aromatic groups derived from unsubstituted and substituted aromatic hydrocarbon compounds;

(h) multivalent heterocyclic groups derived from unsubstituted and substituted heterocyclic compounds; and (i) multivalent organic groups derived from organic compounds in which two or more aromatic or heterocyclic groups are bonded to each other through one or more multivalent groups selected from the above-mentioned groups (a) to (d).

The typical multivalent groups standing for A in the formula (I) are as follows.

| Group | Chemical formula |
|---|---|
| (a) | $-\underset{\underset{O}{\|}}{C}-$, $-\underset{\underset{S}{\|}}{C}-$, $-SO_2-$ |
| (b) | $-CH_2-CH_2-$, $-CH_2-\underset{\underset{\vert}{}}{CH}-CH_2-$, 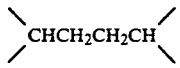 |
| (c) | $-CH_2CH_2-O-CH_2CH_2-$, $-CH_2CH_2-\underset{\underset{CH_2CH_2-}{\vert}}{N}-CH_2CH_2-$ |
| (d) | $-CH_2-\underset{\underset{O}{\|}}{C}-CH_2-$, $-CH_2-\underset{\underset{O}{\|}}{C}-OCH_2CH_2-$ |
| (e) | 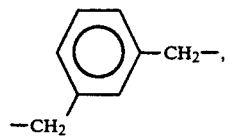 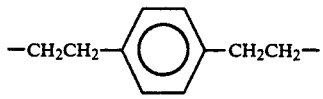 |
| (f) | 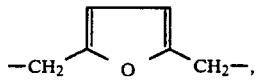 |

-continued

| Group | Chemical formula |
|---|---|
| | 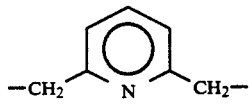 |
| (g) | 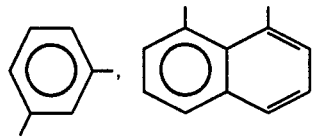 |
| (h) | 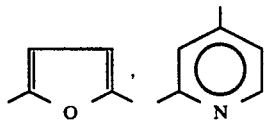 |
| (i) | 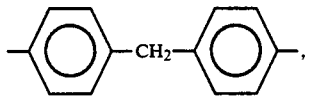 |
| | 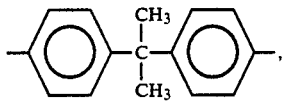 |
| | 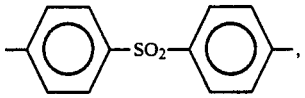 |
| | 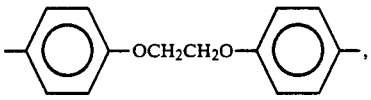 |
| | 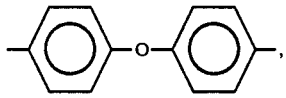 |
| | 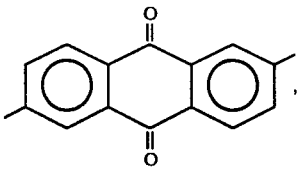 |
| | 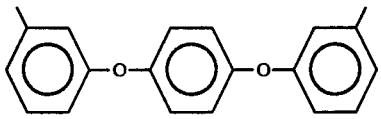 |

In the formula (I), R preferably represents a member selected from the group consisting of p-toluene, o-toluene, 1-naphthalene and p-chloro-benzene groups.

The compounds of the formula (I) include the specific N-arylsulfonyl(thio) urea compounds such as bis(p-toluenesulfonylaminocarbonylamino)ketone,
1,2-bis(p-toluenesulfonylaminocarbonylamino)ethane,
1,1,6,6-tetra(p-toluenesulfonylaminocarbonylamino)-heptane, 1,5-bis(p-toluenesulfonylaminocarbonylamino)-3-oxapentane, 1,5-bis(p-toluenesulfonylaminocarbonylamino)-3-thiopentane,
1,3-bis(p-toluenesulfonylaminocarbonylamino)-2-propanone,
1,5-bis(p-toluenesulfonylaminocarbonylamino)-3-(2'-(p-toluenesulfonylaminocarbonylamino)ethyl)-3-azapentane,
1,3-bis(p-toluenesulfonylaminocarbonylaminomethyl)benzene, 1,4-bis(p-toluenesulfonylaminocarbonylamino)benzene, 4,4'-bis(p-toluenesulfonylaminocarbonylamino) diphenylmethane,
4,4'-bis(o-toluenesulfonylaminocarbonylamino)diphenylmethane,
4,4'-bis(benzenesulfonylaminocarbonylamino)diphenylmethane,
4,4'-bis(1-naphthalenesulfonylaminocarbonylamino)-diphenylmethane,
4,4'-bis(p-toluenesulfonylaminothiocarbonylamino)-diphenylmethane,
2,2-bis(4'-(p-toluenesulfonylaminocarbonylamino)-phenyl)propane,
1,2-bis(4'-(p-toluenesulfonylaminocarbonylamino)-phenyloxy)ethane,
3,3'-bis(p-toluenesulfonylaminocarbonylamino)-diphenylsulfone,
3,3'-bis(p-chlorobenzenesulfonylaminocarbonylamino)diphenylsulfone,
4,4'-bis(p-toluenesulfonylaminocarbonylamino)diphenylether,
2,5-bis(p-toluenesulfonylaminocarbonylaminomethyl)furane,
1,3'-bis(p-toluenesulfonylaminocarbonylamino)benzene,
1,4-bis(p-toluenesulfonylaminocarbonylamino)benzene,
1,5-bis(p-toluenesulfonylaminocarbonylamino)naphthalene,
1,8-bis(p-toluenesulfonylaminocarbonylamino)naphthalene, and
1,4-bis(3'-(p-toluenesulfonylaminocarbonylamino)-phenyloxy)benzene.

Those compounds can be used alone or as a mixture of two or more thereof.

Nearly all of the N-arylsulfonyl(thio) urea compounds of the formula (I) are novel compounds. The compounds of the formula (I) can be prepared in accordance with the following reactions (1) to (5).

Reaction (1):

$$2[R-SO_2NCO] + A\leftarrow NH_2)n \longrightarrow \text{Compound of the formula (I)}$$

Reaction (2):

$$2[R-SO_2NH_2] + A\leftarrow NCO)n \longrightarrow \text{Compound of the formula (I)}$$

Reaction (3):

$$2[R-SO_2NH_2] + A\leftarrow NCS)n \longrightarrow \text{Compound of the formula (I)}$$

Reaction (4):

-continued $$2[R-SO_2NHC(=X)-OR'] + A(NH_2)_n \longrightarrow$$

Compound of the formula (I)

Reaction (5):

$$2[R-SO_2NH_2] + A(NHC(=X)-OR')_n \longrightarrow$$

Compound of the formula (I)

In the above chemical formulae, R, A, X and n are as defined above, and R' represents a member selected from the group consisting of lower alkyl groups having 1 to 8 carbon atoms and a phenyl group.

The reactions are usually carried out in a solvent medium that is not restricted to a specific group of compounds as long as it does not have an activated hydrogen atom and is not reactive with isocyanate compounds.

Preferably, the color developing compound of the formula (I) in the thermosensitive colored image-forming layer is present in an amount of 5 to 50%, preferably, 10 to 40%, based on the total dry weight of the thermosensitive colored image-forming layer.

When the content of the color developing compound of the formula (I) is less than 5% by weight, the resultant thermosensitive colored image-forming layer sometimes exhibits an unsatisfactory color-forming performance, and when the content of the color developing compound of the formula (I) is more than 50% by weight, the resultant color-developing performance is saturated, and thus the resultant recording material is sometimes economically disadvantageous.

The thermosensitive colored image-forming layer of the present invention comprises a specific additive comprising at least one member selected from:

(1) aromatic epoxy compounds having at least one epoxy group per molecule thereof;

(2) aromatic aziridine compounds having at least one aziridinyl group per molecule thereof;

(3) aromatic compounds of the formulae (II), (III) and (IV);

(4) aromatic sulfonyl compounds different from the compounds of the formulae (I), (II), (III) and (IV), provided with at least one sulfonyl group per molecule thereof and having a melting point of from 60° C. to 160° C.; and (5) basic white pigments.

The aromatic epoxy compound (1) has, per molecule thereof, at least one epoxy group of the formulae;

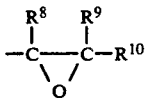

wherein $R^8$, $R^9$ and $R^{10}$ respectively and independently from each other represent a member selected from a hydrogen atom, alkyl groups preferably having 1 to 4 carbon atoms and aralkyl groups, for example, benzyl, phenethyl, and cumyl groups, and aryl groups, for example, phenyl, tolyl, and naphthyl groups.

The aromatic epoxy compounds (1) usable for the present invention are disclosed in Japanese Unexamined Patent Publication Nos. 62-164,579, 2-220,885, and 2-255,376, and preferably selected from the group consisting of 4,4'-bis(2'',3''-epoxypropyloxy)diphenylsulfone, 2,2-bis(4'-(2'',3''-epoxypropyloxy)phenyl)propane, 1,4-bis(2',3'-epoxypropyloxy)benzene, 4-(2'-methyl-2',3'-epoxypropyloxy)-4'-benzyloxydiphenylsulfone, 4-(2'',3''-epoxypropyloxy)-4'-(p-methylbenzyloxy)-diphenylsulfone, epoxidized orthonovolak cresol resins, 4,4'-bis(2'',3''-epoxypropyloxy)diphenylmethane, bis(-2'',3''-epoxypropyl) 4,4''-methylene dibenzoate, 4,4'-bis(2'',3''-epoxypropyloxy) biphenyl, 4,4'-bis(2'',3''-epoxypropyloxy)-3,3',5,5'-tetramethylbiphenyl, 2,6-bis(2',3'-epoxypropyloxy) naphthalene, and bis(2,3-epoxypropyl)terephthalate.

Those aromatic epoxy compounds (1) are employed alone or as a mixture of at least two thereof.

The aromatic epoxy compounds (1) effectively enhance the resistance of the resultant colored images to water, even immediately after the formation of the colored images.

Preferably, the aromatic epoxy compound (1) in the thermosensitive colored image-forming layer is present in an amount of 1 to 30%, preferably 2 to 10%, based on the total dry weight of the thermosensitive colored image-forming layer.

When the aromatic epoxy compounds (1) are employed in an amount of less than 1% by weight, the resultant colored image-stabilizing effect is sometimes unsatisfactory. Also, even if the aromatic epoxy compounds (1) are used in an amount of more than 30% by weight, no further enhancement of the stabilizing effect on the colored images is obtained.

The aromatic aziridine compound (2) usable for the present invention has, per molecule thereof, at least one aziridinyl group of the formula:

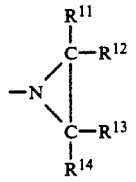

wherein $R^{11}$, $R^{12}$, $R^{13}$ and $R^{14}$ respectively and independently from each other represent a member selected from a hydrogen atom, alkyl groups preferably having 1 to 4 carbon atoms and aralkyl groups, for example, benzyl, phenethyl and cumyl groups, and aryl groups, for example, phenyl, tolyl and naphthyl groups.

The aromatic aziridine compounds (2) are preferably selected from the group consisting of; 2,4-bis(1-aziridinylcarbonylamino)toluene, bis(4-(1-aziridinylcarbonylamino)phenyl)methane, bis(3-chloro-4-(1-aziridinylcarbonylamino)phenyl)methane, 2,2-bis(4-(1-aziridinylcarbonyloxy)phenyl)propane, 1,4-bis(1-aziridinylcarbonyloxy)benzene, and 1,4-bis(1-aziridinylcarbonyl)benzene, and employed alone or as a mixture of two or more thereof.

The aromatic aziridine compounds (2) effectively enhance the resistance of the resultant colored images to water, even immediately after the formation of the colored images.

Preferably, the aromatic aziridine compounds (2) in the thermosensitive colored image-forming layer is present in an amount of 1 to 30%, preferably 2 to 10%, based on the total dry weight of the thermosensitive colored image-forming layer.

When the aromatic aziridine compounds (2) are employed in an amount of less than 1% by weight, the resultant colored image-stabilizing effect is sometimes unsatisfactory. Also, even if the aromatic aziridine compounds (2) are used in an amount of more than 30% by weight, no further enhancement of the stabilizing effect on the colored images is obtained.

In the thermosensitive recording material of the present invention, the aromatic sulfonylamino compounds of the formulae (II), (III) and (IV), effectively enhance the sensitivity of the resultant thermosensitive recording material and the resultant colored images to oily and fatty substances, plasticizers, heat and moisture, even immediately after the formation of the colored images. Also, the aromatic sulfonylamino compounds of the formulae (II), (III) and (IV) serve as an additional color-developing agent to the color-developing agent consisting of the compounds of the formula (I).

The compound of the formula (II) usable for the present invention is preferably selected from the group consisting of: N-benzoylbenzenesulfonamide(m.p.: 147° C.), N-(o-toluoyl)benzenesulfonamide(m.p.: 91° C.), N-(m-toluoyl)benzenesulfonamide(m.p.: 116° C.), N-(p-loluoyl)benzenesulfonamide(m.p.: 135° C.), N-(1-naphthoyl)benzenesulfonamide(m.p.: 174° C.), N-(2-naphthoyl)benzenesulfonamide(m.p.: 151° C.), N-benzoyl-o-toluenesulfonamide (m.p.: 126° C.), N-(o-toluoyl)-o-toluenesul fonamide(m.p.: 136° C.), N-(m-toluoyl)-o-toluenesul fonamide(m.p.: 118° C.), N-(p-toluoyl)-o-toluenesul fonamide(m.p.: 141° C.), N-benzoyl-p-toluenesul fonamide(m.p.: 137° C.), N-(o-toluoyl)-p-toluenesulfonamide (m.p.: 112° C.), N-(m-toluoyl)-p-toluenesulfonamide (m.p.: 132° C.), N-(p-toluoyl)--p-toluenesulfonamide(m.p.: 138° C.), N-(3,4-dimethylbenzoyl)-p-toluenesulfonamide(m.p.: 147° C.), N-(p-chlorobenzoyl)-p-toluenesulfonamide(m.p.: 195° C.), N-(2,5-dichlorobenzoyl)-p-toluenesulfonamide(m.p.: 198° C.), N-(1-naphthoyl)-p-toluenesulfonamide(m.p.: 150° C.), N-(2-naphthoyl)-p-toluenesulfonamide(m.p.: 167° C.), N-(3,4-dimethylbenzoyl)-3,4-dimethylbenzenesulfonamide(m.p.: 119° C.), N-(benzoyl)-mesitylenesulfonamide, N-benzoyl-p-chlorobenzenesulfonamide (m.p.: 184° C.), N-(o-chlorobenzoyl)-1-naphthalene-sulfonamide(m.p.: 177° C.), N-(o-toluoyl)-2-naphthalene-sulfonamide(m.p.: 147° C.), N-(m-toluoyl)-2-naphthalene-sulfonamide(m.p.: 166° C.), N-(p-toluoyl)-2-naphthalene-sulfonamide, N-acetyl-benzenesulfonamide, N-cyclohexane-carbonyl-p-toluenesulfonamide, N-lauroyl-p-toluene-sulfonamide(m.p.: 83° C.), N-myristoyl-p-toluene-sulfonamide(m.p.: 90° C.), N-palmitoyl-p-toluene-sulfonamide(m.p.: 102° C.), N-stearoyl-p-toluene-sulfonamide(m.p.: 99° C.), N-oleoyl-p-toluenesulfonamide, and N-acetylmesitylenesulfonamide(m.p.: 166° C.).

The compound of the formula (III) usable for the present invention is preferably selected from the group consisting of phenyl N-(p-toluenesulfonyl)carbamate (m.p.: 106° C.), 2,3,4-trimethylphenyl N-(p-toluenesulfonyl)-carbamate(m.p.: 144° C.), benzyl N-(p-toluenesulfonyl)carbamate(m.p.: 98° C.), 2-phenoxyethyl-N-(p-toluenesulfonyl)carbamate(m.p.: 120° C.), p-cumylphenyl N-(p-toluenesulfonyl)carbamate(m.p.: 120° C.), o-biphenyl N-(p-toluenesulfonyl)carbamate(m.p.: 136° C.), 1-naphthyl N-(p-toluenesulfonyl)carbamate(m.p.: 148° C.), 1-(4-methoxynaphthyl)N-(p-toluenesulfonyl)carbamate, p-benzyloxycarbonylphenyl N-(p-toluenesulfonyl)carbamate (m.p.: from 112° C. to 130° C.), p-methoxycarbonylphenyl N-(p-toluenesulfonylcarbamate(m.p.: 176° C.), p-n-butoxycarbonylphenyl N-(p-toluenesulfonyl)carbamate (m.p.: 113° C.), p-benzyloxyphenyl N-(p-toluenesulfonyl)carbamate(m.p.: 122° C.), m-benzyloxyphenyl N-(p-toluenesulfonyl)carbamate, p-methoxyphenyl N-(p-toluenesulfonyl)carbamate(m.p.: 95° C.), m-methoxyphenyl N-(p-toluenesulfonyl)carbamate(m.p.: 96° C.), p-ethoxyphenyl N-(p-toluenesulfonyl)carbamate (m.p.: 88° C.), p-n-butoxyphenyl N-(p-toluenesulfonyl) carbamate(m.p.: 114° C.), p-chlorophenyl N-(benzenesulfonyl)carbamate, 2-methoxy-4-arylphenyl N-(p-toluenesulfonyl)carbamate(m.p.: 123° C.), p-methylmercaptophenyl N-(p-toluenesulfonyl)carbamate (m.p.: 95° C.), 3-methyl-4-methylmercaptophenyl N-(p-toluenesulfonyl)carbamate(m.p.: 105° C.), p-biphenyl N-(o-toluenesulfonyl)carbamate, 4-methoxy-1-naphthyl N-(p-toluenesulfonyl)carbamate, 1-naphthyl N-(p-toluenesulfonyl)carbamate(m.p.: 149° C.), p-benzylmercaptophenyl N-(p-toluenesulfonyl)carbamate, p-benzyl N-(1-naphthalenesulfonyl)carbamate, p-tolyl N-(p-toluenesulfonyl)thiocarbamate(m.p.: 95° C.), and p-methylbenzyl N-(p-toluenesulfonyl)dithiocarbamate.

The compound of the formula (IV) usable for the present invention is preferably selected from the group consisting of N-(p-toluenesulfonyl)-N'-phenylurea(m.p.: 165° C.), N-(p-toluenesulfonyl)-N'-(p-methoxyphenyl)urea(m.p.: 155° C.), N-(p-toluenesulfonyl)-N'-(o-tolyl)urea(m.p.: 148° C.), N-(p-toluenesulfonyl)-N'-(m-tolyl)urea(m.p.: 184° C.), N-(p-toluenesulfonyl)-N'-(p-tolyl)urea(m.p.: 149° C.), N-(p-toluenesulfonyl)-N'-(p-n-butylphenyl)urea, N-(p-toluenesulfonyl)-N',N'-diphenylurea(m.p.: 159° C.), N-(p-toluenesulfonyl)-N'-(o-chlorophenyl)urea(m.p.: 180° C.), N-(p-toluenesulfonyl)-N'-(m-chlorophenyl)urea(m.p.: 193° C.), N-(p-toluenesulfonyl)-N'-(2,4-dichlorophenyl)urea, N-(p-toluenesulfonyl)-N'-methyl-N'-phenylurea(m.p.: 155° C.), N-(p-toluenesulfonyl)-N'-benzylurea(m.p.: 177° C.), N-(p-toluenesulfonyl)-N'-(1-naphthyl-)urea(m.p.: 124° C.), N-(p-toluenesulfonyl)-N'-(1-(2-methylnaphthyl)urea, N-(benzenesulfonyl-N'-phenylurea(m.p.: 153° C.), N-(p-chlorobenzenesulfonyl)-N'-phenylurea, N-(o-toluenesulfonyl)-N'-phenylurea, N-(p-toluenesulfonyl)-N'-methylurea(m.p.: 172° C.), N-(p-toluenesulfonyl)-N'-ethylurea(m.p.: 141° C.), N-(p-toluenesulfonyl)-N'-(2-phenoxyethyl-)urea(m.p.: 191° C.), N,N'-bis(p-toluenesulfonyl-)urea(m.p.: 155° C.), N-(p-toluenesulfonyl)-N'-phenylthiourea, N-(p-toluenesulfonyl)-N'-(o-diphenyl-)urea(m.p.: 148° C.), and N-(p-toluenesulfonyl)-N'-(p-ethoxycarbonylphenyl)urea.

In the thermosensitive colored image-forming layer, preferably, the compound of the formula (I) and at least one member selected from the compounds of the formulae (II), (III) and (IV) are in a total amount of 5 to 50%, preferably 10 to 40%, based on the total weight of the thermosensitive colored image-forming layer.

Also, the compound of the formula (I) and at least one member selected from the compounds of the formulae (II), (III) and (IV) contained in the thermosensitive colored image-forming layer are preferably in a weight ratio of from 1/10 to 10/1. If the weight ratio falls outside of the above-mentioned range, the sensitivity-enhancing effect derived from the compounds of the formulae (II), (III) and (IV) employed together with the color-developing compound of the formula (I) becomes unsatisfactory.

The aromatic sulfonyl compounds (4) different from the compounds of the formulae (II), (III) and (IV) and having a melting point of from 60° C. to 160° C. effectively cause the colored images formed in the resultant thermosensitive colored image-forming layer to exhibit an enhanced resistance to the oily or fatty substances, plasticizers, heat and moisture even immediately after the formation of the colored images.

The aromatic sulfonyl compounds (4) contribute to the enhancement of the thermosensitivity of the resultant colored image-forming layer.

When the melting point is lower than 60° C., sometimes the resultant thermosensitive colored-image-forming layer is undesirably colored during the formation thereof otherwise exhibits a lowered whiteness. Also, when the melting point is higher than 160° C., the resultant aromatic sulfonyl compound exhibits an unsatisfactory sensitizing effect for the thermosensitive colored image-forming layer.

The aromatic sulfonyl compounds (4) usable for the present invention can be selected from those disclosed in Japanese Unexamined Patent Publication Nos. 57-38,186, 58-211,493, 59-184,692, 59-39,594, 59-73,990, 60-47,070, 60-72,788, 60-92,890, 60-176,794, 61-89,087, 61-112,689, 62-51,483, 62-56,187, 62-94,381, 62-238,789, 62-263,086, 62-294,589, 63-153,183, 63-178,075, 63-216,787, 63-288,776, 63-296,978, 63-306,083, 64-16,680, 64-27,990, 1-125,280, 1-178,489, 1-214,473, 1-238,982, 2-4,574, 2-6,181, 2-80,285, 2-88,287, 2-88,554, 2-92,579, 2-223,475, 3-36,086, 3-47,791 and 3-142,280.

Typical compounds usable as the aromatic sulfonic compounds (4) of the present invention are: diphenylsulfone(m.p.: 124° C.), phenyl p-toluenesulfonate(m.p.: 96° C.), p-tolyl mesitylenesulfonate(m.p.: 100° C.), 4,4'-diallyloxydiphenylsulfone(m.p.: 145° C.), 4,4'-diisopentyloxydiphenylsulfone(m.p.: 100° C.), 4,4'-di-n-pentyloxydiphenylsulfone(m.p.: 89° C.), 4,4'-dimethoxydiphenylsulfone(m.p.: 130° C.), bis(4-(2-alkanoyl or alkenoyl($C_{14,\ 16\ or\ 8}$)oxy)ethoxy)phenylsulfone, 2,2-bis(4-benzenesulfonyloxyphenyl)propane(m.p.: 114° C.), 2,2-bis(4-methanesulfonyloxyphenyl)propane(m.p.: 101° C.), p-toluenesulfoneamide(m.p.: 102° C.), and N-benzyl-o-sulfophthalimide.

In the thermosensitive colored image-forming layer, the aromatic sulfonyl compounds (4) are present in an amount of 5 to 50%, preferably 10 to 40%, based on the total dry weight of the thermosensitive colored image-forming layer.

When the content of the aromatic sulfonyl amounts (4) is less than 5% by weight, the resultant thermosensitive colored image-forming layer sometimes exhibits an unsatisfactory thermosensitivity. Also, even if the content of the aromatic sulfonyl compounds (4) is raised to more than 50% by weight, there is no further enhancement of the sensitizing effect.

In an embodiment of the present invention, the thermosensitive colored image-forming layer comprises a basic white pigment (5).

The basic white pigment (5) usable for the present invention preferably comprises at least one member selected from precipitated (light) calcium carbonate particles, ground (heavy) calcium carbonate particles, extremely fine calcium carbonate particles, aluminum hydroxide particles, magnesium hydroxide particles, calcium hydroxide particles, magnesium carbonate particles, aluminum silicate particles, talc particles, alkali-modified clay particles, surface-treated calcium carbonate particles and silica particles surface-treated with a basic material. The basic white pigment compounds can be employed alone or as a mixture of two or more thereof.

The basic white pigment (5) usable for the present invention preferably has a basicity of 7 to 13, more preferably 7 to 11.

The basicity can be determined in accordance with the pigment pH determination method B of Japanese Industrial Standard (JIS) K 5101-1978. In this method, a pigment sample in an amount of 5 g is placed in a hard lass triangular flask, 100 g of water that has been preliminarily boiled to remove carbon dioxide gas therefrom, are placed in the flask, and the flask is then corked and shaken to mix the pigment with the water. The mixture is filtered and the resultant filtrate in a 100 ml beaker is subjected to a pH measurement in accordance with JIS Z 8802, item 7. The basicity of the pigment is represented by the measured pH value.

The basic white pigment effectively causes the colored images formed in the resultant colored image-forming layer to exhibit an enhanced substance to oily and fatty substances, plasticizers, heat and moisture even immediately after the formation of the color images.

Also, the basic white pigment causes the resultant colored image-forming layer to exhibit an enhanced degree of whiteness.

The reasons for the above-mentioned specific effects of the basic white pigment are not completely clear. Nevertheless, the enhanced degree of whiteness of the resultant colored image-forming layer is assumed to be derived from the fact that the resultant colored image-forming layer is stably retained in a weak basic condition until an imagewise heating operation is applied to form colored images thereon. However, since the whiteness of the colored image-forming layer can be significantly improved by the addition of a very small amount, for example, 1 to 2% by weight, of the basic white pigment, the whiteness-enhancing effect of the basic white pigment cannot be sufficiently explained solely by the basicity of the pigment.

The basic white pigment (5) is contained preferably in an amount of 1 to 50%, more preferably 5 to 40%, based on the total dry weight of the thermosensitive colored image-forming layer. If the amount of the basic white pigment (5) is less than 1% by weight, the colored image-stabilizing effect and the whiteness-enhancing effect of the basic white pigment (5) are not satisfactory. Also, even if the basic white pigment (5) is employed in a content of 50% by weight or more, the above-mentioned effects are saturated and thus further enhancement is not expected, and sometimes, the thermosensitivity of the resultant colored image-forming layer is unfavorably reduced.

The dye precursor usable for the present invention comprises at least one member selected from conventional triphenylmethane, fluoran, and diphenylmethane leuco dyes, for example, 3-(4-diethylamino-2-ethoxyphenyl)-3-(1-ethyl-2-methylindole-3-yl)-4-azaphthalide, crystal violet lactone, 3-(N-ethyl-N-isopentylamino)-6-methyl-7-anilinofluoran, 3-diethylamino-6-methyl-7-anilinofluoran, 3-diethylamino-6-methyl-7-(2',4'-dimenthylphenylamino) fluoran, 3-(N-ethyl-N-p-toluidino)-6-methyl-7-anilinofluoran, 3-pyrrolidino-6-methyl-7-anilinofluoran, 3-dibutylamino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino)fluoran, 3-dibutylamino-7-(o-chloroanilino)fluoran, methyl-7-chlorofluoran, 3-diethylamino-6-methylfluoran, 3-diethylamino-6-mechylfluorane, 3-cyclohexylamino-6-clorofluoran and 3-(N-ethyl-N-hexylamino)-6-methyl-7-(p-chloroanilino) fluoran.

In the thermosensitive colored image-forming layer of the present invention, the color developing agent optionally contains at least one conventional color-developing compound in addition to the N-drylsulfonyl(thio)urea compound of the formula (I), unless the color-forming performance of the colored image-forming layer is disturbed thereby.

The conventional color developing compound is preferably selected from the group consisting of 2,2-bis (4-hydroxyphenyl)propane (namely bisphenol A), 1,1-bis(4-hydroxyphenyl)-1-phenylethane, 1,4-bis(1-methyl-1-(4'-hydroxyphenyl)ethyl)benzene, 1,3-bis(1-methyl-1-(4'-hydroxyphenyl)ethyl)benzene, dihydroxydiphenylether (disclosed in JP-A-1-180,382), benzyl p-hydroxybenzoate (disclosed in JP-A-52-140,483), bisphenol S, 4-hydroxy-4'-isopropyloxy-diphenylsulfone (disclosed in JP-A-60-13,852), 1,1-di-(4-hydroxyphenyl)-cyclohexane, 1,7-di(4-hydroxyphenylthio)-3,5-dioxaheptane (disclosed in JP-A-59-52,694), and 3,3'-diallyl-4,4'-dihydroxydiphenylsulfone (disclosed in JP-A-60-208,286).

The above-mentioned conventional color developing compounds can be employed alone or as a mixture of two or more thereof.

When the conventional color developing compound is employed, its content in the colored image-forming layer is preferably 5 to 40% by weight.

The binder usable for the present invention preferably comprises at least one member selected from water-soluble polymeric materials, for example, polyvinyl alcohols of various molecular weight, starch and starch derivatives, cellulose derivatives, for example, methoxy cellulose, carboxymethyl cellulose, methyl cellulose and ethyl cellulose, sodium polyacrylate, polyvinyl pyrrolidine, acrylic acid amide-acrylic acid ester copolymers, acrylic acid amide-acrylic acid estermethacrylic acid terpolymers, alkali salts of styrene-maleic anhydride copolymers, polyacrylic acid amide, sodium alginate, gelatine and casein, and water-insoluble polymeric materials, for example, polyvinyl acetate resins, polyurethane resins, styrene-butadiene copolymer resins, polyacrylic acid resins, polyacrylic acid ester resins, vinyl chloride-vinyl acetate copolymer resins, polybutyl acrylate, ethylene-vinyl acetate copolymer resins and styrene-butadiene-acrylic compound-terpolymer resins, used in the form of a latex.

In the thermosensitive colored image-forming layer of the present invention, the dye precursor is present in an amount of 5 to 20% by weight together with 5% to 50% of the color developing compound of the formula (I) and the binder is present in an amount of 5 to 20% by weight, based on the total dry weight of the colored image-forming layer.

The thermosensitive colored image-forming layer of the present invention optionally further comprises a heat-fusible organic substance, usually referred to as a sensitizer, non-basic inorganic and organic pigments, antioxidants, for example, hindered phenol compounds, ultraviolet ray-absorbers, and waxes.

The sensitizing agent comprises at least one organic compound having a melting point of from 50° C. to 150° C., for example, phenyl 1-hydroxy-2-naphthoate (disclosed in JP-A-57-191,089), p-benzylbiphenyl (JP-A-60-82,382), benzylnaphthylether (JP-A-58-87,094), dibenzyl terephthalete (JP-A-58-98,285), benzyl p-benzyloxybenxoate (JP-A-57-201,691), diphenyl carbonate, ditolyl carbonate (JP-A-58-136,489), m-terphenyl (JP-A-57-89,994), 1,2-bis(m-tolyloxy)ethane (JP-A-60-56,588), 1,5-bis(p-methoxyphenoxy)-3-oxapentane (JP-A-62-181,183), oxalic acid diesters (JP-A-64-1,583) and 1,4-bis(p-tolyloxy)benzene (JP-A-2-153,783).

The antioxidant and ultraviolet ray-absorbers are preferably selected from those disclosed in JP-A-57-151,394, JP-A-58-160,191, JP-A-58-69,096, JP-A-59-2,884, JP-A-59-95,190, JP-A-60-22,288, JP-A-60-255,485, JP-A-61-44,686, JP-A-62-169,683, JP-A-63-17,081 and JP-A-1-249,385, for example, 1,1,3-tris(2'-methyl-3'-cyclohexyl-4'-hydroxyphenyl)butane; 1,1,3-tris(2-methyl-4-hydroxy-5-tert-butylphenyl)butane, 4,4'-thio-bis(3-methyl-6-tert-butylphenol), 1,3,5-trimethyl-2,4,6-tris(3,5-di-tert-butyl-4-hydroxybenzyl)-benzene, 2,2'-dihydroxy-4, 4'-dimethoxybenzophenone, p-octylphenyl salycilate, 2-(2'-hydroxy-5'-methylphenyl)benzotriazole, ethyl-2-cyano-3,3'-diphenyl acrylate, and tetra(2,2,6,6-tetramethyl-4-piperidyl)-1,2,3,4-butane-tetracarbonate.

The non-basic inorganic and organic pigments usable for the present invention are preferably selected from inorganic fine particles of, for example, silica, zinc oxide, titanium dioxide, zinc hydroxide, barium sulfate, clay, anhydrous clay, and silica and organic fine particles of, for example, urea-formaldehyde resins, styrene-methacrylate copolymer resins and polystyrene resins.

The waxes usable for the present invention preferably comprise at least one member selected from, for example, paraffin waxes, carnauba wax, microcrystalline waxes, polyethylene waxes, amide type waxes, bisimide type waxes, higher fatty acid amide waxes, for example, stearic acid amide, ethylene-bis-stearoamide wax, higher fatty acid esters and metal salts, for example, zinc stearate, aluminum stearate, calcium stearate, and zinc oleate.

In the colored image forming layer of the present invention, the sensitizing agent is preferably contained in an amount of 10 to 40% by weight, the wax and non-basic organic or inorganic pigment are optionally contained in amounts of 2 to 20% by weight and 2 to 50% by weight, respectively, and the antioxidant and ultraviolet ray-absorber are optionally contained in an amount of 1 to 10%, based on the total dry weight of the colored image-forming layer.

The sheet substrate usable for the present invention is not limited to a specific group of materials, and usually the sheet substrate comprises a member selected from fine paper sheets, coated paper sheets having a clay or latex-coated layer, cast-coated paper sheets, paper boards, plastic resin films, synthetic paper sheets comprising a plastic resin such as a polyolefin resin and a multi-layer structure, and laminated composite sheets. Preferably, the sheet substrate has a basis weight of 40 to 170 g/m$^2$.

The colored image-forming layer can be formed on a surface of sheet substrate, by applying a coating liquid containing the above-mentioned components, and by drying and solidifying the coating liquid layer on the sheet substrate.

The colored image-forming layer is preferably present in a dry weight of from 1 to 15 g/m$^2$, more preferably 2 to 10 g/m$^2$.

In the present thermosensitive recording material, a protective layer and/or a layer for printing may be formed on the colored image-forming layer.

In the thermosensitive recording material of the present invention, the novel color developing compounds of the formula (I) having two or more N-arylsulfonyl(thio) urea groups (V) per molecule thereof exhibit a color-developing activity comparative to or higher than that of bisphenol A which is a typical conventional color developing compound.

Also, the combination of the color developing compound of the formula (I) with the specific additive comprising at least one member selected from the aromatic epoxy compounds (1), the aromatic aziridine compounds (2), the compounds (3) of the formulae (II), (III) and (IV), and the aromatic sulfonyl compounds (4) and the basic white pigment (5) as defined above effectively causes the resultant colored images to exhibit an excellent resistance to oily and fatty substances and a plasticizer even immediately after the color development, and thus have a superior storage persistency.

EXAMPLES

The present invention will be further explained by the following specific examples, which are merely representative and do not in any way restrict the scope of the present invention.

EXAMPLE 1

A thermosensitive recording paper sheet was prepared by the following procedures.

(1) Preparation of an Aqueous Dye Precursor Dispersion A-1

A mixture was prepared in the following composition.

| Component | Part by weight |
|---|---|
| 3-(N-isopentyl-N-ethylamino)-6-methyl-7-anilinofluoran | 20 |
| 10% aqueous solution of polyvinyl alcohol | 10 |
| Water | 70 |

The mixture was dispersed in a sand grinder to an extent such that the resultant dispersed solid particles had an average size of 1 μm or less.

(2 ) Preparation of an Aqueous Color-Developing Agent Dispersion B-1

A mixture was prepared in the following composition.

| Component | Part by weight |
|---|---|
| 4,4'-bis(p-toluenesulfonylaminocarbonyl-amino)diphenylmethane | 10 |
| Di-p-methylbenzyl oxalate | 10 |
| 10% aqueous solution of polyvinyl alcohol | 10 |
| Water | 70 |

The mixture was dispersed in a sand grinder to an extent such that the resultant dispersed solid particles had an average size of 1 μm or less.

(3) Formation of Thermosensitive Colored Image-Forming Layer

A coating liquid was prepared by mixing 50 parts by weight of the aqueous dye precursor dispersion A-1 and 200 parts by weight of the aqueous color-developing agent dispersion B-1 with 25 parts by weight of an aqueous dispersion of an epoxidized orthonovolak cresol resin (available under a trademark of EM-125, from Nagase Kasei K.K., and having a solid content of 20% by weight), 26 parts by weight of a calcium carbonate pigment having a pH of 9.0, 25 parts by weight of a 25% aqueous zinc stearate dispersion, 24 parts by weight of a styrene-butadiene copolymer latex emulsion having a solid content of 50%, and 40 parts by weight of a 10% aqueous polyvinyl alcohol solution, by agitating the mixture.

A surface of a paper sheet having a basis weight of 50 $g/m^2$ was coated with the resultant coating liquid and dried. A thermosensitive colored image-forming layer was formed with a weight of 7.5 $g/m^2$.

(4) Formation of Overcoat Layer

A coating liquid for an overcoat layer was prepared by mixing 5 parts by weight of an aqueous dispersion of kaolinite clay having a solid content of 60% by weight, 35 parts by weight of a 10% aqueous polyvinyl alcohol solution, 22 parts by weight of 10% aqueous casein solution, 1 part by weight of a 25% aqueous zinc stearate dispersion, 2 parts by weight of dimethylolurea cross-linking agent and 35 parts by weight of water while stiring. The coating liquid was coated on the thermosensitive colored image-forming layer and dried, to form an overcoat layer having a dry weight of 1.5 $g/m^2$.

A thermosensitive recording sheet was obtained.

(5) Calendering Treatment

The recording sheet was treated by a super calender, and the calendered surface of the recording sheet had a Bekk smoothness of 600 to 1000 seconds.

(6) Test

Specimens of the resultant thermosensitive recording sheet were printed with letters and bar codes using a label printer (trademark: DP-110GS, made by Teraoka Seiko K.K.). The bar code portion of each specimen was read by a bar code laser checker made by Symbol Technologies Co. The resultant readability (%) was recorded.

Then, the specimens were immersed in pure water at a temperature of 20° C. or 40° C. for 24 hours. The specimens were removed from the water and the water adhering thereon was removed from the specimens. The bar code portions of the specimens were subjected to a reading test using the bar code checker and the resultant readability (%) percentage was recorded.

The higher the readability (%) of the bar codes, the higher the clarity of the bar codes.

The test results are shown in Table 1.

EXAMPLE 2

A thermosensitive recording sheet was prepared and tested using the same procedure as in Example 1 except that during the preparation of the aqueous dispersion B-1, 4,4'-bis(p-toluenesulfonylaminocarbonylamino)diphenylmethane was replaced by 4,4'-bis(p-toluenesulfonylaminocarbonylamino)diphenylether, and di-p-methylbenzyl oxalate was replaced by dibenzyl oxalate.

The test results are shown in Table 1.

EXAMPLE 3

A thermosensitive recording sheet was prepared and tested using the same procedure as in Example 1 except that during the preparation of the aqueous dispersion A-1, 3-(N-isopentyl-N-ethylamino)-6-methyl-7-anilinofluoran was replaced by 3-(N,N-dibutylamino)-6-methyl-7-anilinofluoran, and during the preparation of the aqueous dispersion B-1, 4,4'-bis(p-toluenesulfonylaminocarbonylamino)diphenylmethane was replaced by 4,4'-bis(p-toluenesulfonylaminocarbonylamino)-diphenylsulfone.

The test results are shown in Table 1.

EXAMPLE 4

A thermosensitive recording sheet was prepared and tested using the same procedure as in Example 1 with the following exceptions.

(1) Preparation of a Pigment-Coated Paper Sheet

A coating liquid was prepared by mixing an aqueous anhydrous clay dispersion prepared by dispersing 85 parts by weight of anhydrous clay (trademark: Arisilex, made by Engelhard Corp.) in 320 parts by weight of water, with 40 parts by weight of an aqueous emulsion of a styrene-butadiene copolymer in a solid content of 50% by weight, and 50 parts by weight of a 10% aqueous oxidized starch solution.

The coating liquid was coated on a surface of a fine paper sheet having a basis weight of 48 g/m$^2$, to form a coating layer having a dry weight of 7.0 g/m$^2$. whereby a pigment-coated paper sheet was obtained.

(2) Preparation of an Aqueous Dispersion C-1 of an Epoxy Compound

A mixture was prepared in the following composition.

| Component | Part by weight |
|---|---|
| Bis(2,3-epoxypropyl)terephthalate | 20 |
| 10% aqueous polyvinyl alcohol solution | 10 |
| Water | 70 |

The mixture was dispersed in a sand grinder to an extent that the resultant dispersed solid particles had an average size of 1 μm or less.

(3) Formation of a Thermosensitive Colored Image-Forming Layer

A coating liquid was prepared by evenly mixing 50 parts by weight of the aqueous dispersion A-1 of Example 1, 200 parts by weight of the aqueous dispersion B-1 of Example 2, and 25 parts by weight of the above-mentioned aqueous dispersion C-1, with 23 parts by weight of a calcium carbonate pigment, 20 parts by weight of a 25% aqueous zinc stearate dispersion, 15 parts by weight of a 30% aqueous paraffin dispersion and 120 parts by weight of a 10% aqueous polyvinyl alcohol solution, while stirring.

A surface of the pigment-coated paper sheet was coated with the resultant coating liquid and dried to form a thermosensitive colored image-forming layer with a dry weight of 5.0 g/m$^2$. A thermosensitive recording sheet was obtained.

The test results are shown in Table 1.

EXAMPLE 5

A thermosensitive recording sheet was prepared and tested using the same procedure as in Example 4 except that in the preparation of the aqueous epoxy compound dispersion C-1 bis(2,3-epoxypropyl)terephthalate was replaced by bis(4-(1-aziridinylcarbonylamino)phenyl) methane.

The test results are shown in Table 1.

Comparative Example 1

A thermosensitive recording sheet was prepared and tested using the same procedure as in Example 1, except that during the preparation of the aqueous dispersion A-1, 4,4-bis(p-toluenesulfonylaminocarbonylamino)diphenylmethane was replaced by 2,2-bis(4-hydroxyphenyl)propane(namely bisphenol A), and the epoxidized orthonovolak cresol resin dispersion (trademark: EM-125, made by Nagase Kasei K.K.) was not employed.

The test results are shown in Table 1.

Comparative Example 2

A thermosensitive recording sheet was prepared and tested using the same procedure as in Example 4 except that during the preparation of the aqueous dispersion B-1, 4,4'-bis(p-toluenesulfonylaminocarbonylamino)diphenylmethane was replaced by 1-hydroxy-4'-isopropyloxydiphenylsulfone, and the aqueous dispersion C-1 was not employed.

The test results are shown in Table 1.

TABLE 1

| Item | Readability of bar codes (%) | | |
|---|---|---|---|
| | | After immersion in water for 24 hours | |
| Example No. | Original | 20° C. | 40° C. |
| Example | | | |
| 1 | 100 | 100 | 90 |
| 2 | 100 | 100 | 90 |
| 3 | 100 | 100 | 80 |
| 4 | 100 | 100 | 90 |
| 5 | 100 | 100 | 100 |
| Comparative Example | | | |
| 1 | 100 | 40 | 0 |
| 2 | 100 | 30 | 0 |

Table 1 clearly shows that the colored images formed on the colored image-forming layer of Examples 1 to 5 in accordance with the present invention had an excellent resistance to water compared with those of the Comparative Example 1, in which bisphenol A, which is a typical conventional color-developing agent, was used, and in the Comparative Example 2 in which 1-hydroxy-4'-isopropyloxydiphenylsulfone, which is known as a color-developing agent having a relatively high water-resistance, was used.

EXAMPLE 6

A thermosensitive recording sheet was prepared using the following procedures.

(1) Preparation of a Pigment Coated Paper Sheet

An aqueous dispersion was prepared by dispersing 85 parts by weight of anhydrous clay (trademark: Ansilex) in 320 parts by weight of water.

A coating liquid was prepared by mixing the above-mentioned aqueous anhydrous clay dispersion with 40 parts by weight of a 50% aqueous styrene-butadiene copolymer emulsion and 50 parts by weight of a 10% aqueous oxidized starch solution.

The coating liquid was coated on a surface of a fine paper sheet having a basis weight of 48 g/m$^2$, to form a pigment-coated layer with a dry weight of 7.0 g/m$^2$, whereby a pigment coated paper sheet was 5 obtained.

(2) Preparation of an Aqueous Dye Precursor Dispersion A-2

A mixture was prepared in the following composition.

| Component | Part by weight |
|---|---|
| 3-(N-isopentyl-N-ethylamino)-6-methyl-7-anilinofluoran | 20 |
| 10% aqueous polyvinyl alcohol solution | 10 |
| Water | 70 |

The mixture was dispersed in a sand grinder to an extent that the resultant dispersed solid particles had an average size of 1 μm or less.

(3) Preparation of an Aqueous Color-Developing Agent Dispersion B-2

A mixture was prepared in the following composition.

| Component | Part by weight |
|---|---|
| 4,4'-bis(p-toluenesulfonylamino-carbonylamino)diphenylmethane | 20 |
| 10% aqueous polyvinyl alcohol solution | 10 |
| Water | 70 |

The mixture was dispersed in a sand grinder to an extent that the resultant dispersed solid particles had an average size of 1 μm or less.

(4) Preparation of an Aqueous Sulfonyl Compound (3). Dispersion D-1

A mixture was prepared in the following composition.

| Component | Part by weight |
|---|---|
| N-(o-toluoyl)-p-toluenesulfoamide | 20 |
| 10% aqueous polyvinyl alcohol solution | 10 |
| Water | 70 |

The mixture was dispersed in a sand grinder to an extent that the resultant dispersed solid particles had an average size of 1 μm or less.

(5) Formation of a Thermosensitive Colored Image-Forming Layer.

A coating liquid was prepared by mixing 60 parts by weight of the aqueous dispersion A-2, 120 parts by weight of the aqueous dispersion B-2, and 120 parts by weight of the aqueous dispersion D-1 with 23 parts by weight of a calcium carbonate pigment having a pH of 10.2, 20 parts by weight of a 25% aqueous zinc stearate dispersion, 15 parts by weight of a 30% aqueous paraffin dispersion and 120 Parts by weight of a 10% aqueous polyvinyl alcohol solution while stirring.

The coating solution was coated on a surface of the above-mentioned pigment-coated paper sheet, to form a thermosensitive colored image-forming layer with a dry weight of 5.0 g/m$^2$.

A thermosensitive recording sheet was obtained.

(6) Test

Specimens of the resultant thermosensitive recording sheet were subjected to a colored image-developing test with an applied energy of 0.39 mj/dot or 0.49 mj/dot by using a dynamic color-developing tester provided by modifying a thermosensitive facsimile printer made by Hitachi Seisakusho. The resultant colored images were subjected to a measurement of color density by a Macbeth Reflection Color Density Tester RD-914 (trademark). The measured color density is referred to as an initial color density of the colored images.

The specimens of the recording sheet on which the colored images were formed with an applied energy of 0.49 mj/dot were subjected to a plasticizer resistance test in the following manner.

Within 30 minutes from the completion of the color-developing operation, colored image-formed surfaces of the specimens were coated with dioctyl phthalate (a typical plasticizer) and left to stand at room temperature for 3 hours. Then, the plasticizer was wiped away from the specimen and the color density of the colored images retained on the specimen was measured by a Macbeth Reflection Color Density Tester. The measured color density is referred to as a color density of the plasticizer-treated colored images.

The retention in color density of the colored images was calculated in accordance with the following equation:

$$CIR\ (\%) = \frac{D}{D_0} \times 100$$

wherein CIR represents the retention in % in color density of the colored images, $D_0$ represents the initial color density of the colored images, and D represents the color density of the plasticizer-treated colored images.

The test results are shown in Table 2.

EXAMPLE 7

A thermosensitive recording sheet was prepared and tested using the same procedures as in Example 6 except that in the preparation of the aqueous dispersion A-2 of the Example 6, N-(o-toluoyl)-p-toluenesulfoamide was replaced by benzyl N-(p-toluenesulfonyl)carbamate.

The test results are shown in Table 2.

EXAMPLE 8

A thermosensitive recording sheet was prepared using the following procedures.

(1) Preparation of an Aqueous Dye Precursor Dispersion A-3

A mixture was prepared in the following composition.

| Component | Part by weight |
|---|---|
| 3-(N,N-dibutylamino)-6-methyl-7-anilinofluoran | 20 |
| 10% aqueous polyvinyl alcohol solution | 10 |
| Water | 70 |

The mixture was dispersed in a sand grinder to an extent that the resultant dispersed solid particles had an average size of 1 μm or less.

(2) Preparation of an Aqueous Sulfonyl Compound (3) Dispersion D-2

A mixture was prepared in the following composition.

| Component | Part by weight |
|---|---|
| N-(p-toluenesulfonyl)-N'-phenylurea | 20 |
| 10% aqueous polyvinyl alcohol solution | 10 |
| Water | 70 |

The mixture was dispersed in a sand grinder to an extent that the resultant dispersed solid particles had an average size of 1 μm or less.

(3) Preparation of an Aqueous Sensitizing Agent Dispersion E-1

A mixture was prepared in the following composition.

| Component | Part by weight |
|---|---|
| Di-p-methylbenzyl oxalate | 20 |
| 10% aqueous polyvinyl alcohol solution | 10 |
| Water | 70 |

The mixture was dispersed in a sand grinder to an extent that the resultant dispersed solid particles had an average size of 1 μm or less.

(4) Formation of a Themosensitive Colored Image-Forming Layer

A coating liquid was prepared by mixing 60 parts by weight of the above-mentioned aqueous dispersion A-3, 40 parts by weight of the aqueous dispersion B-2 of Example 6, 80 parts by weight of the above-mentioned aqueous dispersion D-1 and 120 parts by weight of the above-mentioned aqueous dispersion E-1 with 23 parts by weight of a calcium carbonate pigment having a pH of 9.0, 20 parts by weight of a 25% aqueous zinc stearate dispersion, 15 parts by weight of a 30% aqueous paraffin dispersion and 120 parts by weight of a 10% aqueous polyvinyl alcohol solution, while stirring.

The coating liquid was applied to a surface of the pigment-coated paper sheet of Example 6 to provide a thermosensitive colored image-forming layer with a dry weight of 5.0 g/m$^2$. The resultant thermosensitive recording sheet was subjected to the same test as mentioned in Example 6.

The test results are shown in Table 2.

Comparative Example 3

A themosensitive recording sheet was prepared and tested using the same procedure as in Example 6, except that during the formation of the themosensitive colored image-forming layer, the aqueous color-developing agent dispersion B-2 was employed in an amount of 240 parts by weight and the aqueous sulfonyl compound (3) dispersion D-1 was not used.

The test results are shown in Table 2.

Comparative Example 4

A themosensitive recording sheet was prepared and tested using the same procedure as in Example 7, except that the the aqueous sulfonyl compound (3) dispersion D-1 was employed in an amount of 240 parts by weight and the aqueous color developing agent dispersion B-2 was not used.

The Test results are shown in Table 2

TABLE 2

| Item | Initial color density of colored images | | Retention in color |
|---|---|---|---|
| Example No. | 0.39 mj/dot | 0.49 mj/dot | density (%) |
| Example | | | |
| 6 | 1.25 | 1.38 | 81 |
| 7 | 1.27 | 1.38 | 84 |
| 8 | 1.20 | 1.37 | 82 |
| Comparative Example | | | |
| 3 | 0.21 | 0.88 | 90 |
| 4 | 1.02 | 1.20 | 22 |

EXAMPLE 9

A thermosensitive recording sheet was prepared and tested using the same procedure as in Example 6 with the following exceptions.

(1) Formation of a Thermosensitive Colored Image-Forming Layer

A coating liquid was prepared by mixing 60 parts by weight of the aqueous dye precursor dispersion A-3 of Example 8, 80 parts by weight of the aqueous color developing agent dispersion B-2 of Example 6, 40 parts by weight of the aqueous sulfonyl compound (3) dispersion D-2 of Example 8 and 120 parts by weight of the aqueous sensitizing agent dispersion E-1 of Example 8, with 26 parts by weight of a calcium carbonate pigment having a pH of 9.0, 12 parts by weight of a 25% aqueous zinc stearate dispersion, 24 parts by weight of a 50%aqueous styrene-butadiene copolymer emulsion, and 40 parts by weight of a 10% aqueous polyvinyl alcohol solution, while stirring.

The resultant coating liquid was coated and dried on a surface of a fine paper sheet having a basis weight of 50 g/m$^2$ to form a thermosensitive colored image-forming layer with a dry weight of 7.5 g/m$^2$.

(2) Formation of an Overcoat Layer

A coating layer was prepared by mixing 5 parts by weight of an aqueous kaolinite clay dispersion having a solid content of 60% by weight, 35 parts by weight of a 10% aqueous modified polyvinyl alcohol solution, 22 parts by weight of a 10% aqueous casein solution, 1 part by weight of a 25% aqueous zinc stearate dispersion, 2 parts by weight of a dimethylolurea cross-linking agent and 35 parts by weight of water, while stirring.

The coating liquid was coated and dried on the above-mentioned thermosensitive colored image-forming layer to form an overcoat layer having a dry weight of 1.5 g/m$^2$.

A thermosensitive recording sheet was obtained.

The recording sheet was treated by a super calender to provide a calendered surface having a Bekk smoothness of 600 to 1000 seconds.

(3) Test

Specimens of the resultant themosensitive recording sheet were printed with bar codes, letters and squares (7 mm×7 mm) using a label printer (DP-110GS, made by Teraoka Seiko K.K.).

The color density of the printed images was measured by a Macbeth Reflection Color Density Tester RD-914 (trademark).

Also, the printed bar codes were read by a bar code laser checker made by Symbol Technologies Co, and the resultant readability (%) was recorded.

The printed specimens were immersed in a plasticizer consisting of dioctyl terephthalate at a temperature of 20° C. for 24 hours.

The specimens were taken up from the plasticizer and the adhered plasticizer was removed from the specimens.

The specimens were then subjected to a bar code reading test using a bar code checker and the resultant readability (%) was recorded. The closer the readability was to 100%, the higher the clarity of the printed images.

The test results are shown in Table 3.

Comparative Example 5

A thermosensitive recording sheet was prepared and tested using the same procedure as in Example 9, except that in the preparation of the aqueous sulfonyl compound (3) dispersion D-2 of Example 8, N-(p-toluenesulfonyl)-N'-phenylurea was replaced by 2,2-bis(4-(4-hydroxyphenyl)propane, namely bisphenol A, and in the preparation of the coating liquid for the thermosensitive colored image-forming layer, the aqueous dispersion D-2 was employed in an amount of 120 parts by weight and the aqueous color developing agent dispersion B-2 of Example 6 was not employed.

The test results are shown in Table 3.

TABLE 3

| Item Example No. | Color density of colored images | Readability of bar codes (%) Original | After immersion in plasticizer |
|---|---|---|---|
| Example 9 | 1.33 | 100 | 90 |
| Comparative Example 5 | 1.40 | 100 | 0 |

Tables 2 and 3 clearly show that the colored images formed on the thermosensitive recording sheets of Examples 6 to 9 in accordance with the present invention exhibited a satisfactory thermosensitivity and an excellent persistency.

EXAMPLE 10

A thermosensitive recording sheet was prepared by applying the following procedures.

(1) Preparation of a Pigment Coated Paper Sheet

An aqueous dispersion was prepared by dispersing 85 parts by weight of anhydrous clay (trademark: Ansilex) in 320 parts by weight of water.

A coating liquid was prepared by mixing the above-mentioned aqueous anhydrous clay dispersion with 40 parts by weight of a 50% aqueous styrene-butadiene copolymer emulsion and 50 parts by weight of a 10% aqueous oxidized starch solution.

The coating liquid was coated on a surface of a fine paper sheet having a basis weight of 48 g/m$^2$, to form a pigment-coated layer with a dry weight of 7.0 g/m$^2$, whereby a pigment coated paper sheet was obtained.

(2) Preparation of an Aqueous Dye Precursor Dispersion A-4

A mixture was prepared in the following composition.

| Component | Part by weight |
|---|---|
| 3-(N-isopentyl-N-ethylamino)-6-methyl-7-anilinofluoran | 20 |
| 10% aqueous polyvinyl alcohol solution | 10 |
| Water | 70 |

The mixture was dispersed in a sand grinder to an extent that the resultant dispersed solid particles had an average size of 1 μm or less.

(3) Preparation of an Agueous Color-Developing Agent Dispersion B-3

A mixture was prepared in the following composition.

| Component | Part by weight |
|---|---|
| 4,4'-bis(p-toluenesulfonylamino-carbonylamino)diphenylmethane | 20 |
| 10% aqueous polyvinyl alcohol solution | 10 |
| Water | 70 |

The mixture was dispersed in a sand grinder to an extent that the resultant dispersed solid particles had an average size of 1 μm or less.

(4) Preparation of an Aqueous Sulfonyl Compound (4). Dispersion F-1

A mixture was prepared in the following composition.

| Component | Part by weight |
|---|---|
| Diphenylsulfone | 20 |
| 10% aqueous polyvinyl alcohol solution | 10 |
| Water | 70 |

The mixture was dispersed in a sand grinder to an extent that the resultant dispersed solid particles had an average size of 1 μm or less.

(5) Formation of a Thermosensitive Colored Image-Forming Layer

A coating liquid was prepared by mixing 60 parts by weight of the aqueous dispersion A-4, 120 parts by weight of the aqueous dispersion B-3, and 120 parts by weight of the aqueous dispersion F-1 with 23 parts by weight of a calcium carbonate pigment having a pH of 9.0, 20 parts by weight of a 25% aqueous zinc stearate dispersion, 15 parts by weight of a 30% aqueous paraffin dispersion and 120 parts by weight of a 10% aqueous polyvinyl alcohol solution, while stirring.

The coating solution was coated on a surface of the above-mentioned pigment-coated paper sheet, to form a thermosensitive colored image-forming layer with a dry weight of 5.0 g/m$^2$.

A thermosensitive recording sheet was obtained.

(6) Test

Specimens of the resultant thermosensitive recording sheet were subjected to a colored image-developing test with an applied energy of 0.39 mj/dot or 0.49 mj/dot by using a dynamic color-developing tester provided by modifying a thermosensitive facsimile printer made by Hitachi Seisakusho. The resultant colored images were subjected to a color density measurement using a Macbeth Reflection Color Density Tester RD-914 (trademark). The measured color density is referred to as an initial color density of the colored images.

The specimens of the recording sheet, on which the colored images were formed with the applied energy of 0.49 mj/dot, was subjected to a plasticizer resistance test in the following manner.

Within 30 minutes from the completion of the color-developing operation, colored image-formed surfaces of the specimens were coated with dioctyl phthalate (a typical plasticizer) and left to stand at room temperature for 3 hours. Then, the plasticizer was wiped away from the specimens and the color density of the colored images retained on the specimens was measured by a Macbeth Reflection Color Density Tester. The measured color density is referred to as a color density of the plasticizer-treated colored images.

The retention in color density of the colored images was calculated in accordance with the following equation:

$$CIR\ (\%) = \frac{D}{D_0} \times 100$$

wherein CIR represents the retention in % in color density of the colored images, $D_0$ represents the initial color density of the colored images, and D represents the color density of the plasticizer-treated colored images.

The test results are shown in Table 4.

EXAMPLE 11

A thermosensitive recording sheet was prepared and tested using the same procedure as in Example 10 except that in the preparation of the aqueous sulfonyl compound (4) dispersion F-1, diphenylsulfone was replaced by phenyl p-toluenesulfonate.

The test results are shown in Table 4.

EXAMPLE 12

A thermosensitive recording sheet was prepared and tested using the same procedure as in Example 11 except that in the preparation of the aqueous dye precursor dispersion A-4, 3-(N-isopentyl-N-ethylamino)-6-methyl-7-anilinofluoran was replaced by 3-(N,N-dibutylamino)-6-methyl-7-anilinofluoran, and in the preparation of the aqueous color developing agent dispersion B-3, 4,4'-bis(p-toluenesulfonylaminocarbonylamino)diphenylmethane was replaced by 4,4'-bis (p-toluenesulfonylaminocarbonylamino)diphenylether.

The test results are shown in Table 4.

COMPARATIVE EXAMPLE 6

A thermosensitive recording sheet was prepared and tested using the same procedure as in Example 10 except that in the preparation of the aqueous sulfonyl compound (4) dispersion F-1, diphenylsulfone was replaced by phenyl 1-hydroxy-2-naphthoate having a melting point of 94° C.

The test results are shown in Table 4.

COMPARATIVE EXAMPLE 7

A thermosensitive recording sheet was prepared and tested using the same procedure as in Example 10 except that in the preparation of the aqueous sulfonyl compound (4) dispersion F-1, diphenylsulfone was replaced by benzyl terephthalate having a melting point of 95° C.

The test results are shown in Table 4.

TABLE 4

| Item | Initial color density of colored images | | Retention in color |
|---|---|---|---|
| Example No. | 0.39 mj/dot | 0.49 mj/dot | density (%) |
| Example | | | |
| 10 | 1.23 | 1.37 | 85 |
| 11 | 1.24 | 1.38 | 89 |
| 12 | 1.16 | 1.33 | 82 |
| Comparative Example | | | |
| 6 | 0.89 | 1.16 | 82 |
| 7 | 0.79 | 1.10 | 84 |

EXAMPLE 13

A thermosensitive recording sheet was prepared and tested using the same procedure as in Example 10 with the following exceptions.

(1) Preparation of an Aqueous Sulfonyl Compound (4) Dispersion F-2

A mixture was prepared in the following composition.

| Component | Part by weight |
|---|---|
| 4,4'-diallyloxydiphenylsulfone | 20 |
| 10% aqueous polyvinyl alcohol solution | 10 |
| Water | 70 |

The mixture was dispersed by a sand grinder to an extent that the resultant dispersed solid particles had an average size of 1 μm or less, to provide an aqueous dispersion F-2.

(2) Formation of a Thermosensitive Colored Image-Forming Layer

A coating liquid was prepared by mixing 60 parts by weight of the aqueous dye precursor dispersion A-4 of Example 10, 120 parts by weight of the aqueous color developing agent dispersion B-3 of Example 10 and 12 parts by weight of the above-mentioned aqueous sulfonyl compound (4) dispersion F-2, with 26 parts by weight of a calcium carbonate pigment having a pH of 9.0, 12 parts by weight of a 25% aqueous zinc stearate dispersion, 24 parts by weight of a 50% aqueous styrene-butadiene copolymer emulsion, and 40 parts by weight of a 10% aqueous polyvinyl alcohol solution, while stirring.

The resultant coating liquid was coated and dried on a surface of a fine paper sheet having a basis weight of 50 g/m$^2$ to form a thermoensitive colored image-forming layer with a dry weight of 7.5 g/m$^2$.

(3) Formation of an Overcoat Layer

A coating layer was prepared by mixing 5 parts by weight of an aqueous kaolinite clay dispersion having a solid content of 60% by weight, 35 parts by weight of a 10% aqueous modified polyvinyl alcohol solution, 22 parts by weight of a 10% aqueous casein solution, 1 part by weight of a 25% aqueous zinc stearate dispersion, 2 parts by weight of a dimethylolurea cross-linking agent and 35 parts by weight of water, while stirring.

The coating liquid was coated and dried on the above-mentioned thermosensitive colored image-forming layer to form an overcoat layer having a dry weight of 1.5 g/m$^2$.

A thermosensitive recording sheet was obtained.

The recording sheet was treated by a super calender to provide a calendered surface having a Bekk smoothness of 600 to 1000 seconds.

(4) Test

Specimens of the resultant themosensitive recording sheet were printed with bar codes, letters and squares (7 mm×7 mm) using a label printer (DP-110GS, made by Teraoka Seiko K.K.).

The color density of the printed images was measured by a Macbeth Reflection Color Density Tester RD-914 (trademark).

Also, the printed bar codes were read by a bar code laser checker made by Symbol Technologies Co, and the resultant readability (%) was recorded.

The printed specimens were immersed in a plasticizer consisting of dioctyl terephthalate at a temperature of 20° C. for 24 hours.

The specimens were taken up from the plasticizer and the adhered plasticizer on the specimens was removed from the specimens.

Then specimens were subjected to a bar code reading test using a bar code checker and the resultant readability (%) was recorded. The closer the readability was to 100%, the higher the clarity of the printed images.

The test results are shown in Table 5.

COMPARATIVE EXAMPLE 8

A thermosensitive recording sheet was prepared and tested using the same procedure as in Example 13, except that in the preparation of the aqueous color developing agent dispersion B-3 of Example 10, 4,4'-bis(p-toluenesulfonylaminocarboxylamino)diphenylmethane was replaced by 2,2-bis(4-hydroxyphenyl)propane, namely bisyhenol A.

The test results are shown in Table 5.

TABLE 5

| Item Example No. | Color density of colored images | Readability of bar codes (%) Original | After immersion in plasticizer |
|---|---|---|---|
| Example 13 | 1.30 | 100 | 95 |
| Comparative Example 8 | 1.39 | 100 | 0 |

Tables 4 and 5 clearly show that the colored images formed on the thermosensitive recording sheets of Examples 10 to 13 in accordance with the present invention exhibited a satisfactory thermosensitivity and an excellent persistency.

EXAMPLE 14

A thermosensitive recording sheet was prepared by applying the following procedures.

(1) Preparation of an Aqueous Dye Precursor Dispersion A-5

A mixture was prepared in the following composition.

| Component | Part by weight |
|---|---|
| 3-dibutylamino-6-methyl-7-anilinofluoran | 20 |
| 10% aqueous polyvinyl alcohol solution | 10 |
| Water | 70 |

The mixture was dispersed by a sand grinder to an extent that the resultant dispersed solid particles had an average size of 1 μm or less.

(2) Preparation of an Aqueous Color Developing Agent Dispersion B-4

A mixture was prepared in the following composition.

| Component | Part by weight |
|---|---|
| 4,4'-bis(p-toluenesulfonylamino-carbonylamino)diphenylmethane | 10 |
| Diphenylsulfone | 10 |
| 10% aqueous polyvinyl alcohol solution | 10 |
| Water | 70 |

The mixture was dispersed in a sand grinder to an extent that the resultant dispersed solid particles had an average size of 1 μm or less.

(3) Formation of a Thermosensitive Colored Image-Forming Layer

A coating liquid was prepared by mixing 40 parts by weight of the above-mentioned aqueous liquid A-5 and 160 parts by weight of the above-mentioned aqueous dispersion B-4 with 40 parts by weight of a basic calcium carbonate pigment having a pH of 9.0 determined in accordance with JIS K 5101, 20 parts by weight of a 25% aqueous zinc stearate dispersion and 150 parts by weight of a 10% aqueous polyvinyl alcohol solution, while stirring.

The coating liquid was coated and dried on a surface of a fine paper sheet with a basis weight of 50 g/m$^2$ to form a thermosensitive colored image-forming layer having a dry weight of 7.5 g/m$^2$.

(4) Super Calender Treatment

The resultant sheet was treated by a super calender to provide a surface thereof having a Bekk smoothness of 800 to 1000 seconds. A thermosensitive recording sheet was obtained.

(5) Tests on Whiteness, Color-Formation and Oil Resistance (i) Whiteness

Specimens of the thermosensitive recording sheet were subjected to a whiteness measurement using a Hunter Whiteness Tester (trademark, made by Toyo Seiki Seisakusho).

(ii) Color-formation

The specimens were subjected to a bar code-printing procedure using a label printer (trademark: DP-110GS, made by Teraoka Seiko K.K.). The printed bar codes were read using a bar code laser checker made by Symbol Technologies Co. It was confirmed that the readability of the printed bar codes was 90% or more.

(iii) Oil resistance

The printed specimens were immersed in a salad oil at a temperature of 20° C for 24 hours, then wiped to remove the adhered salad oil from the surfaces of the specimens.

The bar codes on the specimens were read by the bar code checker and the resultant readability (%) was recorded.

The test results are shown in Table 6.

EXAMPLE 15

A thermosensitive recording sheet was prepared and tested using the same procedure as in Example 14 except that in the formation of the thermosensitive colored image-forming layer, the basic calcium carbonate pigment in an amount of 40 parts by weight was replaced by a mixture of 8 parts by weight of a basic magnesium carbonate pigment having a pH of 9.0 measured in accordance with JIS K 5101 and 32 parts by weight of anhydrous clay (trademark: Ansilex).

The test results are shown in Table 6.

EXAMPLE 16

A thermosensitive recording sheet was prepared using the same procedure as in Example 14 with the following exceptions.

(1) Preparation of a Pigment-Coated Paper Sheet

An aqueous dispersion was prepared by dispersing 85 parts by weight of an anhydrous clay pigment (trademark: Ansilex) in 320 parts by weight of water.

A coating liquid was prepared by mixing the aqueous anhydrous clay pigment dispersion with 40 parts by weight of an aqueous styrene-butadiene copolymer emulsion having a solid content of 50% by weight and 50 parts by weight of a 10% aqueous oxidized starch solution, while stirring.

The coating liquid was coated and dried on a surface of a fine paper sheet with a basis weight of 48 g/m$^2$ to form a pigment-coated layer having a dry weight of 7.0 g/m$^2$.

A pigment-coated paper sheet was obtained.

(2) Formation of a Thermosensitive Colored Image-Forming Layer

A coating liquid was prepared by mixing 70 parts by weight of the aqueous dye precursor dispersion A-5 of Example 14, and 280 parts by weight of the aqueous color developing agent dispersion B-4 of Example 14, with 10 parts by weight of a basic calcium carbonate having a pH of 9.0, 20 parts by weight of a 25% aqueous zinc stearate dispersion, and 150 parts by weight of a 10% aqueous polyvinyl alcohol solution, while stirring.

The coating liquid was coated and dried on the pigment-coated surface of the pigment-coated paper sheet to form a thermosensitive colored image-forming layer having a dry weight of 5.0 g/m$^2$.

The resultant sheet was calender-treated in the same manner as in Example 14.

The resultant thermosensitive recording sheet was tested in the same manner as mentioned in Example 14.

The test results are shown in Table 6.

EXAMPLE 17

A thermosensitive recording sheet was prepared using the same procedure as in Example 14 with the following exceptions.

(1) Formation of a Thermosensitive Colored Image-Forming Layer

A coating liquid was prepared by mixing 70 parts by weight of the aqueous dye precursor dispersion A-5 of Example 14 and 280 parts by weight of the aqueous color developing agent dispersion B-4 of Example 14, with 8 parts by a basic calcium carbonate pigment having a pH of 9.0, 20 parts by weight of a 25% aqueous zinc stearate dispersion, and 190 parts by weight of a 10% aqueous polyvinyl alcohol solution, while stirring.

The coating liquid was coated on a surface of a fine paper sheet with a basis weight of 50 g/m$^2$ to form a thermosensitive colored image-forming layer having a dry weight of 7.5 g/m$^2$.

(2) Formation of an Overcoat Layer

A coating liquid was prepared by mixing 5 parts by weight of an aqueous kaolinite clay dispersion having a solid content of 60% by weight, 35 parts by weight of a 10% aqueous modified polyvinyl alcohol solution, 22 parts by weight of a 10% aqueous casein solution, 1 part by weight of a 25% aqueous zinc stearate dispersion, 2 parts by weight of a dimethylolurea cross-linking agent and 35 parts by weight of water, while stirring.

The coating liquid was coated on the above-mentioned thermosensitive colored image-forming layer to form an overcoat layer having a dry weight of 1.5 g/m$^2$.

The resultant sheet was treated by a super calender in the same manner as in Example 14.

The resultant thermosensitive recording sheet was subjected to the same test in the same manner as in Example 14.

The test results are shown in Table 6.

EXAMPLE 18

A thermosensitive recording sheet was prepared and tested using the same procedure as in Example 17 except that in the formation of the thermosensitive colored image-forming layer, the basic calcium carbonate pigment was replaced by a basic magnesium carbonate pigment having a pH of 9.9 determined by JIS K 5101.

The test results are shown in Table 6.

EXAMPLE 19

A thermosensitive recording sheet was prepared and tested using the same procedures as in Example 17 except that in the formation of the thermosensitive colored image-forming layer, the basic calcium carbonate pigment was replaced by a basic calcium hydroxide pigment having a pH of 12.3, measured in accordance with JIS K 5101.

The test results are shown in Table 6.

EXAMPLE 20

A thermosensitive recording sheet was prepared and tested using the same procedure as in Example 17 except that in the formation of the thermosensitive colored image-forming layer, the basic calcium carbonate pigment was replaced by a basic aluminum hydroxide pigment having a pH of 9.0 determined in accordance with JIS K 5101.

The test results are shown in Table 6.

COMPARATIVE EXAMPLE 9

A thermosensitive recording sheet was prepared and tested using the same procedure as in Example 14 except that in the formation of the thermosensitive colored image-forming layer, the basic calcium carbonate pigment was replaced by a non-basic anhydrous clay pigment having a pH of 6.4 determined in accordance with JIS K 5101.

The test results are shown in Table 6.

COMPARATIVE EXAMPLE 10

A thermosensitive recording sheet was prepared and tested using the same procedure as in Example 14 except that in the formation of the thermosensitive colored image-forming layer, the basic calcium carbonate pigment was replaced by a non-basic silica pigment having a pH of 6.7 determined in accordance with JIS K 5101.

The test results are shown in Table 6.

COMPARATIVE EXAMPLE 11

A thermosensitive recording sheet was prepared and tested using the same procedure as in Example 17 except that in the formation of the thermosensitive colored image-forming layer, the basic calcium carbonate pigment was replaced by a non-basic anhydrous clay pigment having a pH of 6.4 determined in accordance with JIS K 5101.

The test results are shown in Table 6.

COMPARATIVE EXAMPLE 12

A thermosensitive recording sheet was prepared and tested using the same procedure as in Example 14 except that in the preparation of the aqueous color developing agent dispersion B-4 used for the thermosensitive colored image-forming layer, 4,4'-bis(p-toluenesulfonylaminocarbonylamino)diphenylmethane was replaced by 2,2-bis(4-hydroxyphenyl)propane, namely bisphenol A.

The test results are shown in Table 6.

TABLE 6

| Item Example No. | Whiteness | Resistance to oily substance (Readability %) |
|---|---|---|
| Example | | |
| 14 | 87.0 | ≧80 |
| 15 | 86.8 | ≧80 |
| 16 | 86.2 | ≧80 |
| 17 | 85.6 | ≧80 |
| 18 | 84.3 | ≧80 |
| 19 | 83.3 | ≧80 |
| 20 | 83.7 | ≧80 |
| Comparative Example | | |
| 9 | 72.3 | ≧80 |
| 10 | 71.2 | ≧80 |
| 11 | 73.2 | ≧80 |
| 12 | 86.4 | <10 |

Table 6 clearly indicates that the thermosensitive colored image-forming layer of Examples 14 to 20 in accordance with the present invention exhibited a high level of whiteness and the colored images formed thereon had an excellent storage persistency.

We claim:

1. A thermosensitive recording material comprising:

a sheet substrate and a thermosensitive colored image-forming layer formed on a surface of the sheet substrate and comprising a substantially colorless dye precursor, a color developing agent reactive with the dye precursor upon heating to thereby develop a color, and a binder, said color developing agent comprising at least one compound of the formula (I):

$$(R-SO_2NH\underset{\underset{X}{\|}}{C}HNH)_n A \quad (I)$$

wherein X represents a member selected from the group consisting of oxygen and sulfur atoms, R represents a member selected from the group consisting of unsubstituted aromatic hydrocarbon groups and substituted aromatic hydrocarbon groups having at least one susbstituent selected from the group consisting of lower alkyl groups and halogen atoms; A represents a multivalent group, and n represents an integer of 2 or more, and said thermosensitive colored image-forming layer further comprising an additive comprising at least one member selected from the group consisting of:

(1) aromatic epoxy compounds having at least one epoxy group per molecule thereof, (2) aromatic aziridine compounds having at least one aziridinyl group per molecule thereof, (3) aromatic compounds of the formulae (II), (III) and (IV):

$$R^1-SO_2NH\underset{\underset{Y}{\|}}{C}-R^2 \quad (II)$$

wherein Y represents a member selected from the group consisting of oxygen and sulfur atoms, $R^1$ represents a member selected from the group consisting of unsubstituted aromatic ring groups, and substituted benzene ring groups having at least one substituent selected from the group consisting of lower alkyl groups and halogen atoms, and $R^2$ represents a member selected from the group consisting of alkyl groups, aralkyl groups, unsubstituted aromatic ring groups, and substituted aromatic ring groups having at least one substituent selected from the groups consisting of alkyl; groups, aryl groups, aralkyl groups and halogen atoms, $$R^3-SO_2NH\underset{\underset{Z}{\|}}{C}-Q-R^4 \quad (III)$$

wherein Z and Q respectively and independently from each other represent a member selected from the group consisting of oxygen and sulfur atoms; $R^3$ represents a member selected from the group consisting of unsubstituted benzene ring groups, unsubstituted aromatic ring groups and substituted benzene ring groups having at least one substituent selected from the group consisting of lower alkyl groups, aryl groups and halogen atoms, and $R^4$ represents a member selected from the group consisting of (i) aralky groups, (ii) alkyl groups substituted with an aryloxy group, (iii) substituted benzene ring groups, (iv) substituted polynuclear aromatic ring groups, (v) unsubstituted benzene ring groups and (vi) unsubstituted polynuclear aromatic ring groups, wherein each or the substituted benzene ring groups (iii) and the substituted polynuclear aromatic ring groups (iv) has at least one substituent selected from the group consisting of alkyl, alkenyl, aryl, aralkyl, alkyloxy, aryloxy, aralkyloxy, alkylmercapto, arylmercapto, aralkylmercapto, alkyloxycarbonyl, aryloxycarbonyl, aralkyloxycarbonyl groups and halogen atoms, and

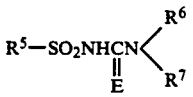

(IV)

wherein E represents a member selected from the group consisting of oxygen and sulfur atoms; $R^5$ represents a member selected from the group consisting of unsubstituted aromatic ring groups, and substituted benzene ring groups having at least one substituent selected from the group consisting of lower alkyl groups and halogen atoms, and $R^6$ and $R^7$ respectively and independently from each other represents a member selected from the group consisting of a hydrogen atom, unsubstituted alkyl groups, aralkyl groups, alkyl groups substituted with an aryloxy group, unsubstituted aromatic ring groups, and unsubstituted aromatic ring groups having at least one substituent selected from the group consisting of alkyl, aryl, aralkyl, alkyloxy, alkyloxycarbonyl, aryloxycarbonyl, aralkyloxycarbonyl, arylsulfonyl and halogen, (4) aromatic sulfonyl compounds different from the compounds of the formulae (I), (II), (III) and (IV), provided with at least one sulfonyl group per molecule thereof and having a melting point of from 60° C. to 160° C., and (5) basic white pigments.

2. The thermosensitive recording material as claimed in claim 1, wherein the multivalent group represented by A in the formula (I) is selected from the group consisting of:

(a) carbonyl groups, thiocarbonyl groups sulfonyl groups, (b) multivalent aliphatic hydrocarbon groups, (c) multivalent, hetero-atom-containing aliphatic groups derived from aliphatic hydrocarbon compounds having at least one hetero-atom located in a backbone chain per molecule thereof, (d) multivalent aliphatic groups derived from aliphatic hydrocarbon compounds having at least one member selected from the group consisting of carbonyl, thiocarbonyl, imide, imino, sulfonyl and ester structures, said member being located in a backbone chain per molecule thereof, (e) multivalent aliphatic groups derived from aliphatic hydrocarbon compounds having at least one member selected from the group consisting of unsubstituted and substituted aromatic hydrocarbon groups, said member being located in a backbone chain per molecule thereof, (f) multivalent organic groups derived from aliphatic hydrocarbon compounds having at least one member selected from the group consisting of unsubstituted and substituted hetero-cyclic groups, said member being located in a backbone chain per molecular thereof, (g) multivalent aromatic groups derived from unsubstituted and substituted aromatic hydrocarbon compounds, (h) multivalent heterocyclic groups derived from unsubstituted and substituted heterocyclic compounds, and (i) multivalent organic groups derived from organic compounds in which two or more aromatic or heterocyclic groups are bonded to each other through one or more multivalent groups selected from the above-mentioned groups (a) to (d).

3. The thermosensitive recording material as claimed in claim 1, wherein the multivalent group represented by A in the formula (I) is selected from the group consisting of:

(a) $-\underset{\underset{O}{\|}}{C}-$, $-\underset{\underset{S}{\|}}{C}-$, $-SO_2-$, (b) $-CH_2-CH_2-$, $-CH_2-\underset{\underset{|}{}}{CH}-CH_2-$,

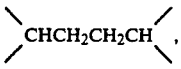

(c) $-CH_2CH_2-O-CH_2CH_2-$, $-CH_2CH_2-\underset{\underset{CH_2CH_2-}{|}}{N}-CH_2CH_2-$, (d) $-CH_2-\underset{\underset{O}{\|}}{C}-CH_2-$, $-CH_2-\underset{\underset{O}{\|}}{C}-OCH_2CH_2-$, (e)

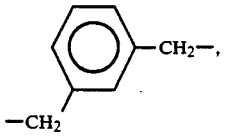

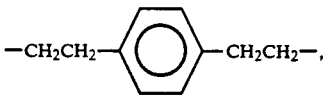

(f)

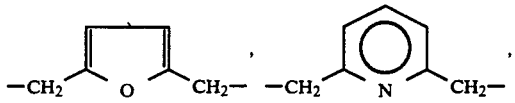

(g)

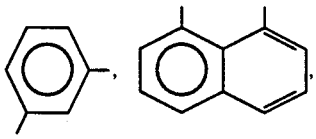

(h)

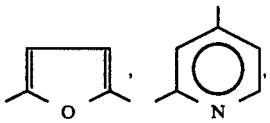

-continued (i) 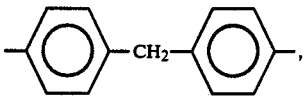

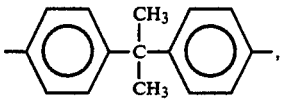

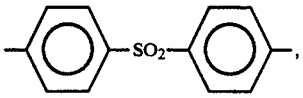

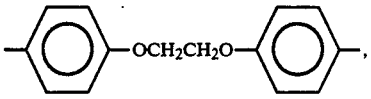

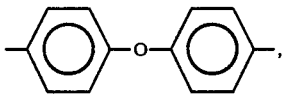

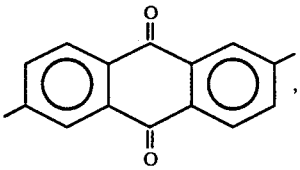

and

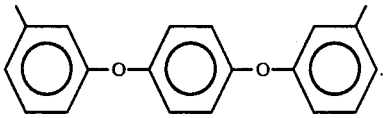

4. The thermosensitive recording material as claimed in claim 1, wherein the compound of the formula (I) is selected from the group consisting of:

bis(p-toluenesulfonylaminocarbonylamino)ketone,
1,2-bis(p-toluenesulfonylaminocarbonylamino)ethane,
1,1,6,6-tetra(p-toluenesulfonylaminocarbonylamino)-heptane, 1,5-bis(p-toluenesulfonylaminocarbonylamino)-3-oxapentane, 1,5-bis(p-toluenesulfonylaminocarbonylamino)-3-thiopentane,
1,3-bis(p-toluenesulfonylaminocarbonylamino)-2-propanone,
1,5-bis(p-toluenesulfonylaminocarbonylamino)-3-(2'-(p-toluenesulfonylaminocarbonylamino)ethyl)-3-azapentane,
1,3-bis(p-toluenesulfonylaminocarbonylaminomethyl)benzene, 1,4-bis(p-toluenesulfonylaminocarbonylamino)benzene, 4,4'-bis(p-toluenesulfonylaminocarbonylamino)diphenylmethane,
4,4'-bis(o-toluenesulfonylaminocarbonylamino)diphenylmethane,
4,4'-bis(benzenesulfonylaminocarbonylamino)diphenylmethane,
4,4'-bis(1-naphthalenesulfonylaminocarbonylamino)-diphenylmethane,
4,4'-bis(p-toluenesulfonylaminothiocarbonylamino)-diphenylmethane,
2,2-bis(4'-(p-toluenesulfonylaminocarbonyiamino)-phenyl)propane,
1,2-bis(4'-(p-toluenesulfonylaminocarbonylamino)-phenyloxy)ethane,
3,3'-bis(p-toluenesulfonylaminocarbonylamino)-diphenylsulfone,
3,3'-bis(p-chlorobenzenesulfonylaminocarbonylamino)diphenylsulfone,
4,4'-bis(p-toluenesulfonylaminocarbonylamino)diphenylether,
2,5-bis(p-toluenesulfonylaminocarbonylaminomethyl)furane,
1,3-bis(p-toluenesulfonylaminocarbonylamino)benzene,
1,4-bis(p-toluenesulfonylaminocarbonylamino)benzene,
1,5-bis(p-toluenesulfonylaminocarbonylamino)naphthalene, 1,8-bis(p-toluenesulfonylaminocarbonylamino)naphthalene, and
1,4-bis(3'-(p-toluenesulfonylaminocarbonylamino)-phenyloxy)benzene.

5. The thermosensitive recording material as claimed in claim 1, wherein the compound of the formula (I) is present in an amount of 5 to 50% based on the total dry weight of the thermosensitive colored image-forming layer.

6. The thermosensitive recording material as claimed in claim 1, wherein the aromatic epoxy compound (1) for the additive is selected from the group consisting of 4,4'-bis(2'',3''-epoxypropyloxy)diphenylsulfone,
2,2-bis(4'-(2'',3''-epoxypropyloxy)phenyl)propane,
1,4-bis(2',3'-epoxypropyloxy)benzene,
4-(2'-methyl-2'3'-epoxypropyloxy)-4'-benzyloxydiphenylsulfone, 4-(2'',3''-epoxypropyloxy)-4'-(p-methylbenzyloxy)-diphenylsufone, epoxidized orthonovolak cresol resines,
4,4'-bis(2'',3''-epoxypropyloxy)diphenylmethane,
bis(2'',3''-epoxypropyl)4,4''-methylene dibenzoate,
4,4'-bis(2'',3''-epoxypropyloxy)biphenyl,
4,4'-bis(2'',3''-epoxypropyloxy)-3,3',5,5'-tetramethylbiphenyl,
2,6-bis(2',3'-epoxypropyloxy)naphthalene, and bis(2,3-epoxypropyl)terephthalate.

7. The thermosensitive recording material as claimed in claim 1, wherein the aromatic epoxy compound (1) is present in an amount of 1 to 30% based on the total dry weight of the thermosensitive colored image-forming layer.

8. The thermosensitive recording material as claimed in claim 1, wherein the aromatic aziridine compound (2) for the additive is selected from the group consisting of 2,4-bis(1-aziridinylcarbonylamino)toluene, bis(4-(1-aziridinylcarbonylamino)phenyl)methane, bis(3-chloro-4-(1-aziridinylcarbonylamino)phenyl)methane, 2,2-bis(4-1-aziridinylcarbonyloxy)phenyl)propane, 1,4-bis(1-aziridinylcarbonyloxy)benzene, and 1,4-bis(1-aziridinylcarbonyl)benzene.

9. The thermosensitive recording material as claimed in claim 1, wherein the aromatic aziridine compound (2) is present in an amount of 1 to 30% based on the total dry weight of the thermosensitive colored image-forming layer.

10. The thermosensitive recording material as claimed in claim 1, wherein the compound of the formula (II) is selected from the group consisting of N-benzoylbenzenesulfonamide,
N-(o-toluoyl)benzenesulfonamide,
N-(m-toluoyl)benzenesulfonamide, N-(poluoyl)benzensulfonamide,
N-(1-naphthoyl)benzenesulfonamide,
N-(2-naphthoyl)benzenesulfonamide,
N-benzoyl-o-toluenesulfonamide,
N-(o-tolnoyl)-o-toluenesulfonamide,
N-(m-toluoyl)-o-toluenesulfonamide,
N-(p-toluoyl)-o-toluenesulfonamide,
N-benzoyl-p-toluenesulfonamide,
N-(o-toluoyl)-p-toluenesulfonamide,
N-(m-toluoyl)-p-toluenesulfonamide,
N-(p-toluoyl)-p-toluenesulfonamide,
N-(3,4-dimethylbenzoyl)-p-toluenesulfonamide,
N-(p-chlorobenzoly)-p-toluenesulfonamide,
N-(2,5-dichlorobenzoyl)-p-toluenesulfonamide,
N-(1-naphthoyl)-p-toluenesulfonamide,
N-(2-naphthoyl)-p-toluenesulfonamide,
N-(3,4-dimethylbenzoyl)-3,4-dimethylbenzenesulfonamide,
N-(benzoyl)-mesitylenesulfonamide,
N-benzoyl-p-chlorobenzenesulfonamide,
N-(o-chlorobenzoyl)-l-naphthalenesulfonamide,
N-(o-toluoyl)-2-naphthalenesulfonamide,
N-(m-toluoyl)-2-naphthalenesulfonamide,
N-(p-toluoyl)-2-naphthalenesulfonamide,
N-acetyl-benzenesulfonamide,
N-cyclohexanecarbonyl-p-toluenesulfonamide,
N-lauroyl-p-toluenesulfonamide,
N-myristoyl-p-toluenesulfonamide,
N-palmitoyl-p-toluenesulfonamide,
N-stearoyl-p-toluenesulfonamide,
N-oleoyl-p-toluenesulfonamide, and
N-acetylmesitylenesulfonamide.

11. The thermosensitive recording material as claimed in claim 1, wherein the compound of the formula (III) is selected from the group consisting of phenyl N-(p-toluenesulfonyl)carbamate,
2,3,4-trimethylphenyl N-(p-toluenesulfonyl)-carbamate,
benzyl N-(p-toluenesulfonyl)carbamate,
2-phenoxyethyl N-(p-toluenesulfonyl)carbamate,
p-cumylphenyl N-(p-toluenesulfonyl)carbamate,
o-biphenyl N-(p-toluenesulfonyl)carbamate,
1-naphthyl N-(p-toluenesulfonyl)carbamate,
1-(4-methoxynaphthyl) N-(p-toluenesulfonyl)carbamate,
p-benzyloxycarbonylphenyl N-(p-toluenesulfonyl)-carbamate,
p-methoxycarbonylphenyl N-(p-toluenesulfonyl)carbamate,
p-n-butoxycarbonylphenyl N-(p-toluenesulfonyl)carbamate,
p-benzyloxyphenyl N-(p-toluenesulfonyl)carbamate,
m-benzyloxyphenyl N-(p-toluenesulfonyl)carbamate,
p-methoxyphenyl N-(p-toluenesulfonyl)carbamate,
m-methoxyphenyl N-(p-toluenesulfonyl)carbamate,
p-ethoxyphenyl N-(p-toluenesulfonyl)carbamate,
p-n-butoxyphenyl N-(p-toluenesulfonyl)carbamate,
p-chlorophenyl N-(benzenesulfonyl)carbamate,
2-methoxy-4-arylphenyl N-(p-toluenesulfonyl)carbamate,
p-methylmercaptophenyl N-(p-toluene-sulfonyl)carbamate,
3-methyl-4-methylmercaptophenyl N-(p-toluenesulfonyl)carbamate,
p-biphenyl N-(o-toluenesulfonyl)-carbamate,
4-methoxy-l-naphthyl N-(p-toluenesulfonyl)carbamate,
1-naphthyl N-(p-toluenesulfonyl)carbamate,
p-benzylmercaptophenyl N-(p-toluenesulfonyl)carbamate,
p-benzyl N-(1-naphthalenesulfonyl)-carbamate,
p-tolyl N-(p-toluenesulfonyl)thiocarbamate, and
p-methylbenzyl N-(p-toluenesulfonyl)dithiocarbamate.

12. The thermosensitive recording material as claimed in claim 1, wherein the compound of the formula (IV) is selected from the group consisting of
N-(p-toluenesulfonyl)-N'-phenylurea,
N-(p-toluenesulfonyl)-N'-(p-methoxyphenyl)urea,
N-(p-toluenesulfonyl)-N'-)o-tolyl)urea,
N-(p-toluenesulfonyl)-N'-(m-tolyl)urea,
N-(p-toluenesulfonyl)-N'-(p-tolyl)urea,
N-(p-toluenesulfonyl)-N'-(p-n-butylphenyl)urea,
N-(p-toluenesulfonyl)-N',N'-diphenylurea,
N-(p-toluenesulfonyl)-N'-(o-chlorophenyl)urea,
N-(p-toluenesulfonyl)-N'-(m-chlorophenyl)urea,
N-(p-toluenesulfonyl)-N'-(2,4-dichlorophenyl)urea,
N-(p-toluenesulfonyl )-N'-methyl-N'-phenylurea,
N-(p-toluenesulfonyl )-N'-benzylurea,
N-(p-toluenesulfonyl )-N'-(1-naphthyl)urea,
N-( p-toluenesulfonyl)-N'-(1-(2-methylnaphthyl)-)urea,
N-( benzenesulfonyl)-N'-phenylurea,
N-( p-chlorobenzenesulfonyl)-N'-phenylurea,
N-(o-toluenesulfonyl)-N'-phenylurea,
N-(p-toluenesulfonyl)-N'-methylurea,
N-(p-toluenesulfonyl)-N'-ethylurea,
N-(p-toluenesulfonyl)-N'-(2-phenoxyethyl)urea,
N,N'-bis(p-toluenesulfonyl)urea,
N-(p-toluenesulfonyl)-N'-phenylthiourea,
N-(p-toluenesulfonyl)-N'-(o-diphenyl)urea, and
N-(p-toluenesulfonyl)-N'-(p-ethoxycarbonylphenyl-)urea.

13. The thermosensitive recording material as claimed in claim 1, wherein the compound of the formula (I) and at least one member selected from the compounds of the formulae (II), (III) and (IV) in the thermosensitive colored image-forming layer are present in a total amount of 5 to 50% based on the total dry weight of the thermosensitive colored image-forming layer.

14. The thermosensitive recording material as claimed in claim 1, wherein the compound of the formula (I) and at least one member selected from the compounds of the formulae (II), (III) and (IV) in the thermosensitive colored image-forming layer are in a weight ratio of from 1/10 to 10/1.

15. The thermosensitive/recording material as claimed in claim 1, wherein the sulfonyl compound (4) for the additive is selected from the group consisting of
diphenylsulfone,
phenyl p-toluenesulfonate,
p-tolyl mesitylenesulfoante,
4,4'-diallyloxydiphenylsulfone,
4,4'-diisopentyloxydiphenylsulfone,
4,4'-di-n-pentyloxydiphenylsulfone,
4,4'-dimethoxydiphenylsulfone,
bis(4-(2-alkanoyl($C_{14,\ 16\ or\ 18}$)oxy)ethoxy)phenylsulfone,
bis(4-(2-alkenoyl($C_{14,\ 16\ or\ 18}$)oxy)ethoxy)phenylsulfone,
2,2-bis(4-benzenesulfonyloxyphenyl)propane,
2,2-bis(4-methanesulfonyloxyphenyl)propane,
p-toluenesulfoneamide, and
N-benzyl-o-sulfophthalimide.

16. The thermosensitive recording material as claimed in claim 1, wherein the aromatic sulfonyl compound is present in an amount of 5 to 50% based on the total dry weight of the thermosensitive colored image-forming layer.

17. The thermosensitive recording material as claimed in claim 1, wherein the basic white pigment (5) comprises at least one member selected from precipitated calcium carbonate particles, ground calcium carbonate particles, calcium carbonate particles, aluminum hydroxide particles, magnesium hydroxide particles, calcium hydroxide particles, magnesium carbonate particles, aluminum silicate particles, talc particles, alkali-modified clay particles, surface-treated calcium carbonate particles and silica particles surface-treated with a basic material.

18. The thermosensitive recording material as claimed in claim 1, wherein the basic white pigment has a basicity of 7 to 13.

19. The thermosensitive recording material as claimed in claim 1, wherein the basic white pigment (5) is present in an amount of 1 to 50% based on the total dry weight of the thermosensitive colored image-forming layer.

* * * * *